US005106676A

United States Patent [19]

Sato et al.

[11] Patent Number: 5,106,676

[45] Date of Patent: * Apr. 21, 1992

[54] TRANSFER MEDIUM FOR HEAT-SENSITIVE TRANSFER RECORDING

[75] Inventors: Hiroshi Sato, Hiratsuka; Kazumi Tanaka, Yokohama; Naoki Kushida, Yokohama; Masato Katayama, Yokohama; Yasuyuki Tamura, Yokohama; Tetsuo Hasegawa, Tokyo; Hisao Yaegashi, Yokohama; Shuzo Kaneko, Tokyo; Koichi Tohma, Kawasaki; Takayuki Suzuki, Saitama, all of Japan

[73] Assignee: Canon Kabushiki Kaisha, Tokyo, Japan

[ * ] Notice: The portion of the term of this patent subsequent to Nov. 14, 2006 has been disclaimed.

[21] Appl. No.: 393,945

[22] Filed: Aug. 15, 1989

Related U.S. Application Data

[62] Division of Ser. No. 819,497, Jan. 16, 1986, Pat. No. 4,880,324.

[30] Foreign Application Priority Data

Jun. 24, 1985 [JP] Japan ..... 60-136179
Jun. 24, 1985 [JP] Japan ..... 60-136180
Dec. 28, 1985 [JP] Japan ..... 60-298831

[51] Int. Cl.[5] ..... B41M 5/26

[52] U.S. Cl. ..... 428/212; 428/195; 428/329; 428/331; 428/336; 428/913; 428/914

[58] Field of Search ..... 428/195, 207, 212, 484, 428/488.1, 488.4, 913, 914, 329, 331, 336

[56] References Cited

U.S. PATENT DOCUMENTS 4,880,686 11/1989 Yaegashi et al. ..... 428/212

*Primary Examiner*—Pamela R. Schwartz
*Attorney, Agent, or Firm*—Fitzpatrick, Cella, Harper & Scinto

[57] ABSTRACT

A heat-sensitive transfer medium comprising a support and at least two heat-transferable ink layers including a first and a second ink layer. The first ink layer has relative adhesions with the second ink layer and the support which are reverse at a higher temperature from those at a lower temperature. When the heat-sensitive transfer medium is superposed with paper, a heat energy is applied, and the transfer medium is separated from the paper; the second ink layer is selectively transferred or both the first and second ink layers are transferred to the paper depending on the length of time from the heat application until the separation of the transfer medium, whereby two color images can be formed by a single transfer medium.

17 Claims, 9 Drawing Sheets

TRANSFER MEDIUM FOR HEAT-SENSITIVE TRANSFER RECORDING

This application is a division of application Ser. No. 819,497, filed Jan. 16, 1986, now U.S. Pat. No. 4.880,324.

FIELD OF THE INVENTION AND RELATED ART

The present invention relates to a transfer medium, method, and apparatus for obtaining multi-color recording images, and more particularly, to a transfer medium, method and apparatus for obtaining two-color images with good color separation by heat-sensitive transfer recording.

The heat-sensitive transfer recording method has recently been widely used because it has general advantages of the heat-sensitive recording method such that the apparatus employed is light in weight, compact, free of noise, excellent in operability and adapted to easy maintenance, and also has other advantanges such that it does not require a color-formation type converted paper but provides recorded images with excellent durability.

The heat-sensitive recording method generally employs a heat-sensitive transfer medium comprising a heat-transferable ink containing a colorant dispersed in a heat-fusible binder coated by melting on a support generally in the form of sheet. The recording is generally conducted by superposing the heat-sensitive transfer medium on a recording medium such as paper so that the heat-transferable ink layer will contact the recording medium, supplying heat from the support side of the heat-sensitive transfer medium by means of a thermal head to transfer the molten ink layer to the recording medium, thereby forming a transferred ink image corresponding to the heat supplying pattern on the recording medium.

Further, there is also a commercial demand for a method of obtaining two-color images while retaining the advantages of the heat-sensitive transfer recording method as described above. Accordingly, there have been proposed several techniques for obtaining two-color images.

In order to obtain two-color images on plain paper by the heat-sensitive transfer recording method, Japanese Laid-Open Patent Application No. 148591/1981 discloses a two-color type heat-sensitive transfer recording element (transfer medium) comprising a substrate and two heat-fusible ink layers including a high-melting point ink layer A aand a low-melting point ink layer B containing mutually different colorants disposed in this order on the substrate. When a low thermal input energy is applied to the elements, only the low-melting point layer B is transferred onto plain paper, while when a high thermal imput energy is applied to the element, both the heat-fusible ink layers A and B are transferred onto the plain paper, so that two-color images can be obtained.

Japanese Laid-Open Application No. 64389/1984 discloses a two-color heat-sensitive transfer ink sheet which comprises, on a substrate, an ink layer which melt-exudes at a lower temperature and another ink layer which is melt-peeled at a higher temperature than the melt-exudation temperature.

In the methods using the above mentioned heat-sensitive transfer media, two-color recording is effected by changing the energy applied to a thermal head at two levels so as to change the temperature of the ink layers. Moreover, when a high energy is input to the ink layers to provide a high temperature, a lower temperature portion is formed at the periphery of a higher temperature portion due to heat diffusion, so that a bordering of a lower temperature color is formed around the higher temperature printed image. Further, when a high energy is supplied to a thermal head, it requires a relatively long time until the thermal head is cooled so that a higher-temperature printed image is liable to be accompanied with a trailing of a lower-temperature color. In any of the above methods, there is a constraint that a relatively low melting material is required for providing an ink to be transferred at a lower temperature, whereby they give rise to problems such as ground soiling and low storability.

SUMMARY OF THE INVENTION

A principal object of the present invention is to dissolve the above-mentioned problems accompanying the prior art and to provide a heat-sensitive transfer recording method capable of providing clear two-color recorded images on plain paper while retaining various heat-sensitive transfer performances.

A further object of the present invention is to provide a heat-sensitive transfer medium for use in multi-color recording by the above mentioned heat-sensitive transfer recording method.

A still further object of the present invention is to provide an apparatus adapted for practicing the above mentioned heat-sensitive transfer recording method.

According to one aspect of the present invention, there is provided a heat-sensitive transfer recording method, comprising: producing a heat-sensitive transfer medium comprising a support and at least two heat-transferable ink layers including a first ink layer and a second ink layer disposed in the order named on the support, superposing the transfer medium on the recording medium so that the ink layers contact the recording medium, applying heat to the transfer medium in a pattern corresponding to information to be recorded, and separating the transfer medium from the recording medium in a length of time until separation counted from the heat application, thereby to leave a transferred ink pattern on the recording medium; the length of time until separation being so controlled that the transferred ink pattern left on the recording medium comprises a prescribed ink layer of said at least two heat transferable ink layers.

According to another aspect of the invention there is provided a heat-sensitive transfer medium, comprising: a support and at least two heat-transferable ink layers including a first layer and a second ink layer disposed in the order named on the support; the relation with respect to largeness of adhesion between the adhesion between the first and second ink layers and the adhesion between the first ink layer and the support being reversed in the course of cooling of the ink layers after application of heat thereto in an amount sufficient to cause thermal transfer of the ink layers.

The adhesion or separation between the first and second ink layers or between the first ink layer and the support can be controlled by the insertion of such a layer as an adhesive layer or a substantially infusible fine powder layer or by the inclusion of a separation promoter agent in the ink layers.

According to a further aspect of the present invention, there is provided a heat-senitive transfer recording apparatus, comprising: means for superposing a heat-sensitive transfer medium comprising a support and an ink layer disposed on the support, and a recording medium so that the ink layer contact the recording medium; means for applying a heat energy to the transfer medium in a pattern corresponding to information to be recorded; and means for controlling the temperature of the ink layer at the time of the separation of the transfer medium from the recording medium by defining a time from the heat-energy application until the separation of the transfer medium from the recording medium.

These and other objects, features and advantages of the present invention will become more apparent upon a consideration of the following description of the preferred embodiments of the present invention taken in conjunction with the accompanying drawings, wherein like parts are denoted by like reference numerals. In the description appearing hereinafter, "part(s)" and "%" used for describing quantities are by weight unless otherwise noted specifically.

DETAILED DESCRIPTION OF THE INVENTION

Figure 1:
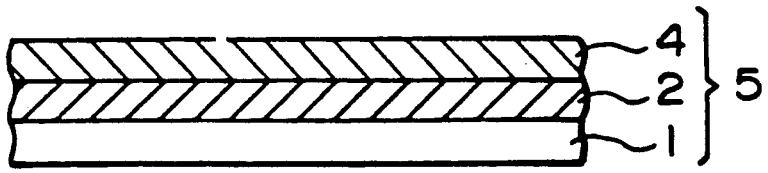
FIG. 1 is a schematic sectional view in the thickness direction of a heat-sensitive transfer medium according to the present invention.

FIG. 1 is a schematic sectional view in the thickness direction of a most basic embodiment of the heat-sensitive transfer medium according to the invention. More specifically, the heat-sensitive transfer medium 5 comprises a support 1 in the form of a sheet, and a first ink layer 2 and a second ink layer 4 formed on and in this order from the support 1.

In the heat-sensitive transfer medium 5 according to the present invention, the relation with respect to strength of adhesion between the first ink layer 2 and the second ink layer 4, and the adhesion between the first ink layer 2 and the support 1, must be inverted between those at a high temperature and at a low temperature, i.e., in the course of cooling of the ink layers after application of heat thereto sufficient to cause thermal transfer of the ink layers. For example, when the transfer medium 5 is heated, the ink layers 2 and 4 are so constituted that the separation between the first ink layer 2 and the second ink layer 4 is better than that between the first ink layer 2 and the support 1 immediately after heating, and the separation between the first ink layer 2 and the support 1 becomes relatively easier after a considerable time has passed from the heating until the separation of the support 1 from a recording medium, i.e., at the time when the transfer medium is cooled after the transfer medium 5 and the recording medium has been superposed, heated and passed through a thermal head (as by movement of the thermal head).

The above mentioned characteristics of the respective layers will be further explained with reference to FIG. 2(*a*).

Incidentally, the relative adhesion between the second and first ink layers and that between the first ink layer and the support are evaluated according to such a standard that the latter adhesion is larger if the second ink layer is substantially selectively transferred, and that the former is larger if substantially both the ink layers are transferred, respectively, when transfer recording is effected on a recording medium. This evaluation standard is not affected by the form of separation between ink layers (e.g., whether or not the separation between the second and first ink layers has occurred strictly at the boundary between these layers, or whether or not some adhesive layer, if any, remains on the heat-sensitive transfer medium).

Figure 2A:
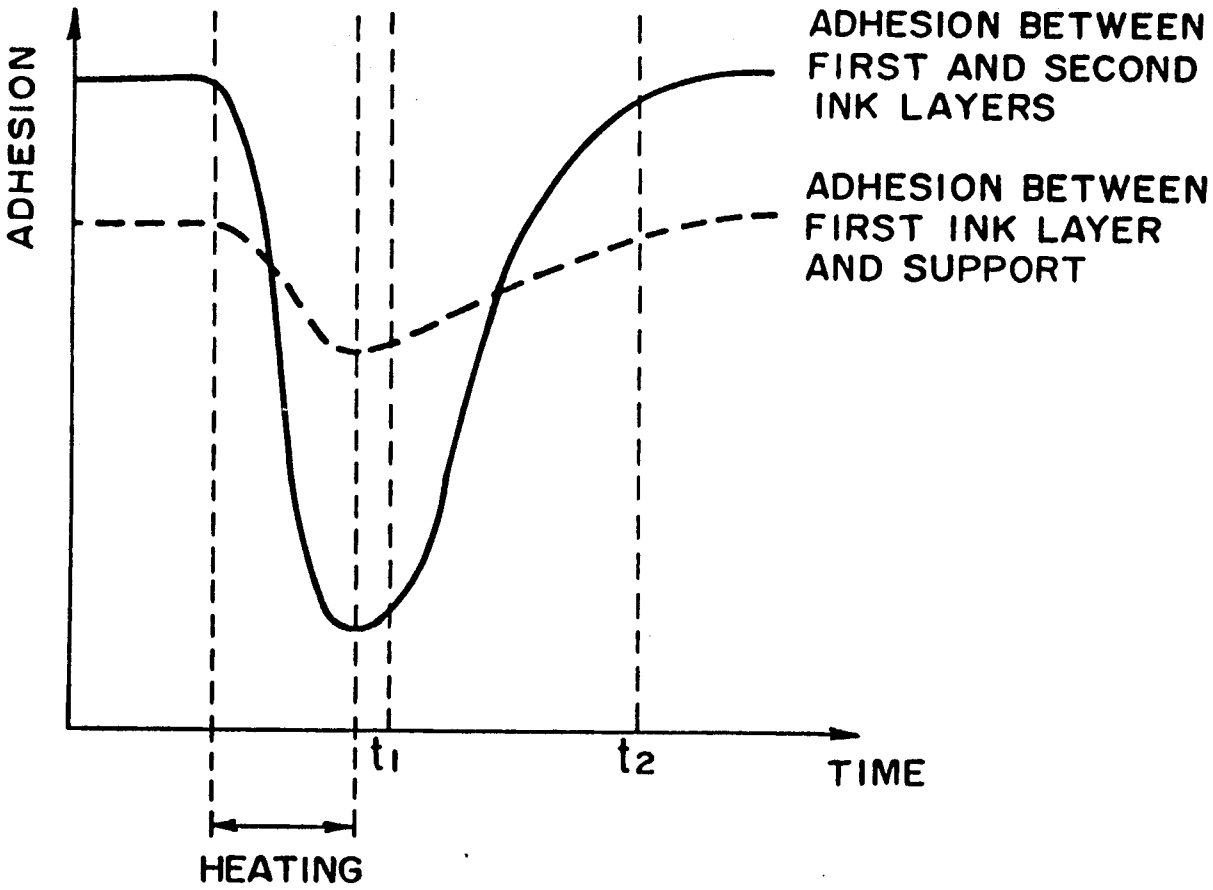
FIGS. 2(*a*) to 2(*c*) respectively show a variation of adhesion strength between various layers with the elapse of time.
Figure 2B:
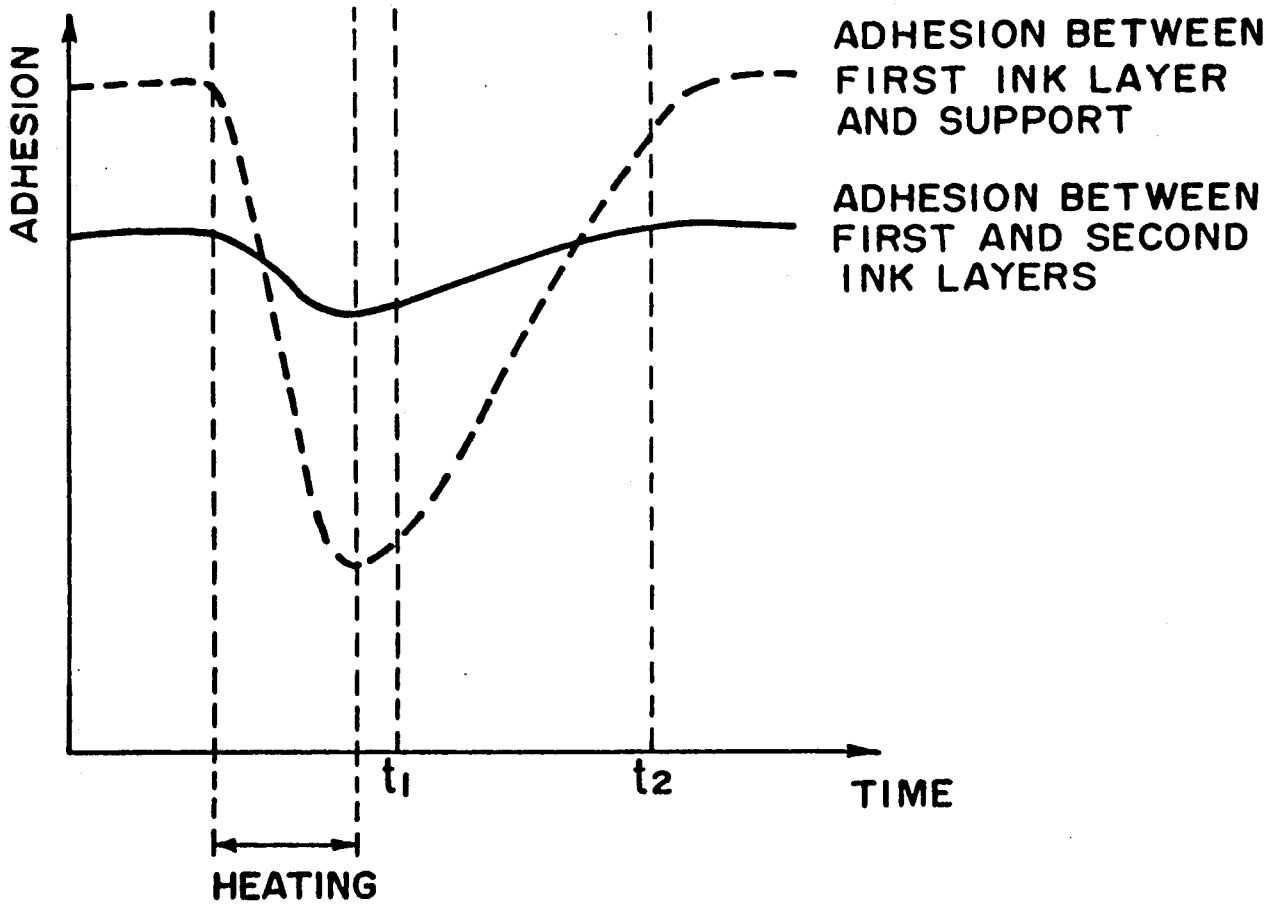
Figure 2C:
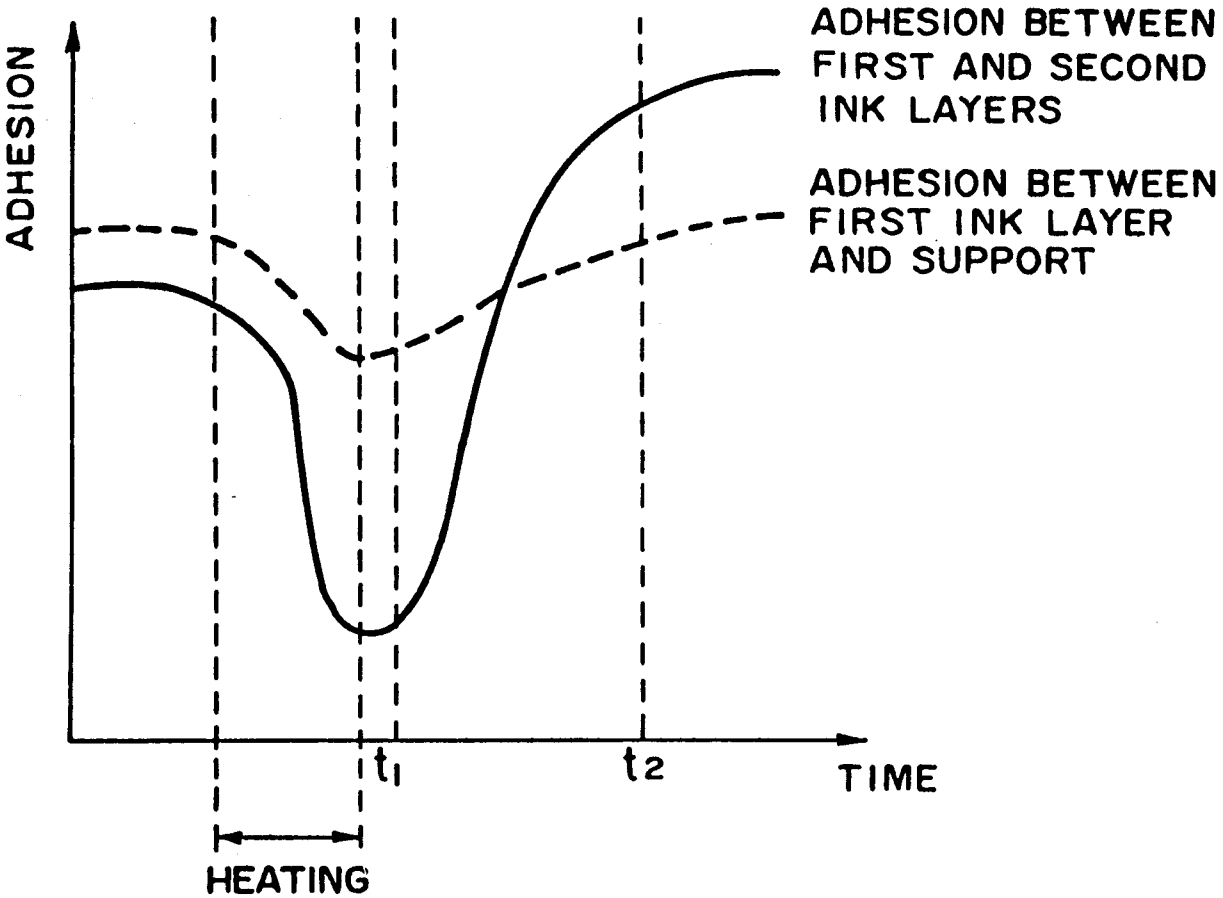

Now, referring to FIG. 2(*a*), the adhesion between the first ink layer 2 and the second ink layer 4, and the adhesion between the first ink layer 2 and the support 1, change on heating and cooling. The heat-sensitive transfer medium according to the invention is so composed that in the state immediately after heating, i.e., before the temperature is lowered, the adhesion between the first ink layer 2 and the second ink layer 4 is weaker than the adhesion between the first ink layer 2 and the support 1. Accordingly, if the transfer medium is peeled from the recording medium immediately after the transfer medium is heated while the second ink layer 4 thereof being in contact with the recording medium, i.e., at time $t_1$ in FIG. 2(*a*), only the second ink layer 4 is transferred. In contrast, if the transfer medium is peeled from the recording medium at a time $t_2$ in FIG. 2(*a*) when a little time has passed after heating and the adhesion between the first ink layer 2 and the second ink layer 4 is recovered to exceed the adhesion between the first ink layer 2 and the support 1, the first ink layer 2 is transferred together with the second ink layer 4. Accordingly, if the color tones of the first ink layer 2 and the second ink layer 4 are composed to be different from each other in the heat-sensitive transfer medium of the present invention, two-color recorded images can be obtained.

When the color of the first ink layer 2 and the second ink layer 4 are desired to be obtained substantially as they are, it is preferred to dispose a first ink layer 2 of a dark color such as black and a second ink layer 4 of a brighter color than that of the first ink layer such as red. On the other hand, when the color of the second ink layer 4 and the mixed color of the first and second ink layers are desired, a magenta color and a red color (mixed color of yellow and magenta), for example, can be obtained if a first ink layer 2 of yellow and a second ink layer 4 of magenta are used in combination. Herein, the mixed color or mixing of color is caused generally by seeing-through to the second ink layer through the first ink layer on the recording medium but can also be caused by material mixing of the two ink layers.

Further, the first and second ink layers can be made in the same hue but different in density from each other, whereby two-color images with dense and pale portions can be obtained in the same manner as described above.

In another embodiment, the respective layers of the heat-sensitive transfer medium as shown in FIG. 1 may be consituted to satisfy the following relative adhesions. Thus, immediately after heating, the separation between the first ink layer 2 and the support 1 is better than the separation between the first ink layer 2 and the second ink layer 4, whereas after a relatively long time, the second ink layer 4 may be separated from the first ink layer 2 relatively easier. The adhesion characteristics of the respective layers are explained by referring to FIG. 2(*b*) as follows. Thus, immediately after heating (at time $t_1$), the adhesion between the support 1 and the first ink layer 2 is weaker than the adhesion between the first and second layers. In contrast, when the temperature of the transfer medium is lowered, the adhesion between the substrate 1 and the first ink layer 2 is recovered to exceed the adhesion between the first ink layer 2 and the second ink layer 4.

In the above embodiments explained with reference to FIGS. 2(*a*) and 2(*b*), the relative adhesions between the layers after a substantial time after heating are essentially the same as those before heating. This is, however, not an essential requirement. For example, it is sufficient that the requirement of the inversion of the relative adhesions is satisfied only in the cooling period after heating but is not satisfied before the initiation of heating, respectively, with respect to the relative adhesions on or immediately after heating, e.g., as shown in FIG. 2(*c*). Such a relationship is realized, e.g., when the ink layers are formed by emulsion-coating. In this case, the states of the ink layers after a little while after heating can be different from those of the ink layers before heating. Further, the separation between the first ink layer 2 and the support need not necessarily occur at the boundary between them but may occur within the first ink layer 2.

As the support 1, it is possible to use films or papers known in the art as such. For example, films of plastics having relatively good heat-resistance such as polyester, aramid resin, polycarbonate, triacetylcellulose, nylon, polyimide, etc., Cellophane cellulose produce (E.I. du Pont de Nemours & Co., Inc.) or parchment paper preferable. The support should preferably have a thickness desirably of about 1 to 15μ, particularly 3 to 12μ, when a thermal head is used as a heating source during heat transfer. Too thich a support is not desirable because the heat conductivity becomes inferior. If a sufficient heat resistance and a strength are attained, a support may be thinner than 3μ. However, the thickness is not particularly limited when a heating source capable of heating selectively the heat-transferable ink layer such as laser beam is used. Also, in the case of using a thermal head, the surface of the support to contact the thermal head can be provided with a heat-resistant protective layer comprising a silicone resin, a fluorine-containing resin, a polyimide resin, an epoxy resin, a phenolic resin, a melamine resin or nitrocellulose to improve the heat resistance of the support. Alternatively, a support material which could not be used in the prior art can also be used by provision of such a protective layer.

For providing the first embodiment explained with reference to FIG. 2(*a*), the first ink layer 2 is required to be readily separated from the second ink layer 4. Further, the first ink layer 2 is required to be relatively easily peeled off from the support 1 at a time when the transfer medium is retained for a substantial time after heating and before peeling off from the support 1, i.e., at a time when the transfer medium 5 is considerably cooled after it has been superposed with the recording medium, heated and has passed through a thermal head.

The heat-fusible binder constituting the first ink layer 2 may include principal components selected from natural waxes such as whale wax, beeswax, lanolin, carnauba wax, candelilla wax, montan wax, ceresin wax and the like; petroleum waxes such as paraffin wax and microcrystalline wax; synthetic waxes such as oxidized wax, ester wax, low molecular weight polyethylene, Fischer-Tropsch wax and the like; higher fatty acids such as lauric acid, myristic acid, palmitic acid, stearic acid, behenic acid and the like; higher alcohols such as stearyl alcohol, behenyl alcohol and the like; esters such as fatty acid esters of sucrose, fatty acid esters of sorbitane and the like; amides such as stearamide, oleic amide and the like in a proportion of preferably 20% or more, further preferably 50% or more. These components may also be mixed, as desired, with resins such as polyolefin resins, polyamide resins, polyester resins, epoxy resins, polyurethane resins, acrylic resins, polyvinyl chloride resins, vinyl acetate resins, cellulose resins, polyvinyl alcohol resins, petroleum resins, phenolic resins, styrene resins, vinyl acetate resins, terpene resins, rosin, modified rosin and others; elastomers such as natural rubber, styrene-butadiene rubber, isoprene rubber, chloroprene rubber and the like; polyisobutylene, polybutene, plasticizers oils such as mineral oils or vegetable oils. The binder may preferably be selected to provide an ink layer having a softening point in the range of 50° to 150° C. and a melt viscosity (by a rotary viscometer) at 150° C. of 10–1,000,000 cps. desirably 10–10,000 cps., particularly 10–500 cps. in combination with a colorant and other additives.

The "softening temperature" used herein is a flow initiation temperature as obtained from an apparent viscosity-temperature curve of a sample ink based on a measurement by a flow tester (Model: CFT500, available from Shimazu Seisakusho K.K.) under the conditions of a load of 10 kg, and a temperature increasing rate of 2° C./min.

The second ink layer 4 is required to be melted or softened on heating by a thermal head to firmly stick to a recording medium and does not readily mix, in its molten state, with the first ink layer 2. For this purpose, the heat-fusible binder resin constituting the second ink layer 4 preferably comprises 20% or more, particularly 50% or more of a resin as selected from the above mentioned class of resins and other ingredients, as desired, such as waxes, plasticizers, and oils such as mineral ooils or vegetable oils to form an ink layer having a softening point of 60° to 180° C., and a melt viscosity (by a rotary viscometer) at 150° C. of 200 cps. to 1,000,000 cps.

Further, in order to promote the cutting of the second ink layer 4, the second ink layer may be formed in the form of dots or provided with a surface unevenness, as desired.

In order to provide the relative adhesion characteristics as shown in FIG. 2(*b*) to the heat-sensitive transfer medium shown in FIG. 1, it is preferred to compose the first and second ink layers so that both ink layers have a softening temperature in the range of 60°-180° C., and the melt viscosity (by a rotary viscometer) at 150° C. is 10 to 1,000,000 cps. for the first ink layer and 200 to 1,000,000 cps. for the second ink layer. The first and second ink layers having the relative adhesions as shown in FIG. 2(*b*) may be formed by appropriately mixing the above mentioned resins or waxes, plasticizers, mineral oils, vegetable oils, colorants and other additives, as desired.

The first ink layer 2 and the second ink layer 4 may preferably have a thickness in the range of 0.5 to 10μ, respectively, and the total thickness of the heat-transferable ink layer may preferably be within the range of 2 to 20μ.

Various two-color combinations can be obtained by using different kinds and concentrations of colorants and/or different proportions in thickness of ink layers.

The colorant to be used may be various dyes and pigments widely employed in the field of printing or recording. The contents of the colorant may suitably be in the range of 1 to 80% for the ink layers 2 and 4, respectively. The ink layers 2 and 4 may respectively contain optional additives such as a dispersant, or a filler such as metal fine powder, inorganic fine powder, or metal oxide.

It is preferred that the materials, particularly the binders, constituting the first ink layer 2 and the second ink layer 4, respectively, are incompatible with each other. However, even if they are compatible or mutually soluble, the separation between the two layers is possible by utilization of difference in melt viscosity.

The heat-sensitive transfer medium according to the present invention can be prepared by fusion blending or kneading with an appropriate solvent of the heat-fusible binder, colorant and other additives to be optionally added by means of a dispersing means such as an attritor for each of the first and the second ink layers 2 and 4 obtain inks which are heat-fused or in the state of solutions or dispersions, applying these inks successively on the support, followed by drying, if desired, thus forming successively the first ink layer and the second ink layer.

The planar shape of the heat-sensitive transfer medium of the present invention is not particularly limited, but it is generally shaped in the form of a ribbon as in a type writer ribbon or a rather wide tape as used in line printers, etc.

Now, the operation of a heat-sensitive transfer recording method employing the above heat-sensitive transfer medium is described by referring to the case in which a thermal head is employed as the most typical heat source.

Figure 3:
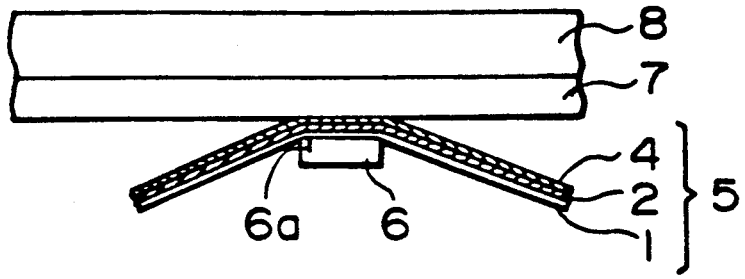
FIGS. 3 and 4 are plan views of a combination of a transfer medium according to the invention and a recording material for illustrating a mode wherein the transfer medium is peeled off from the recording medium immediately after heating.
Figure 4:
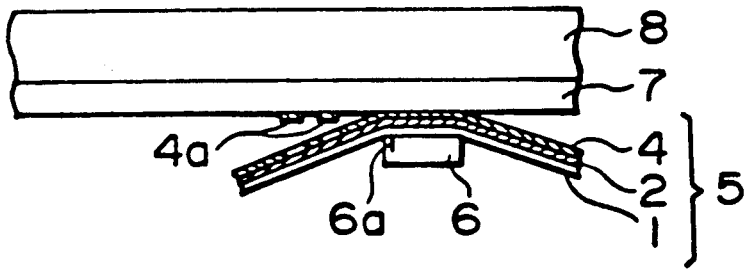

FIGS. 3 and 4 are sectional views taken in the thickness direction of the transfer medium for illustrating a mode of operation wherein only a second ink layer 4 is transferred. FIG. 3 shows a state before the transfer recording. Referring to FIG. 3, a reference numeral 5 denotes a heat-sensitive transfer medium as described above; 6 a thermal head; 6*a* a heater portion of the thermal head; 7 a recording medium; and 8 a platen.

In this embodiment, the first ink layer 2 is colored in black and the second ink layer 4 is in red. FIG. 4 shows a state after transfer recording. Thus, the thermal head 6 has passed in the right direction and the transfer medium is wound up about a reel (not shown), whereby the transfer medium 5 is peeled off from the recording medium 7 just after it has passed through the heater portion 6*a* of the thermal head 6 to leave red images 4*a* on the recording medium 7.

Figure 5:
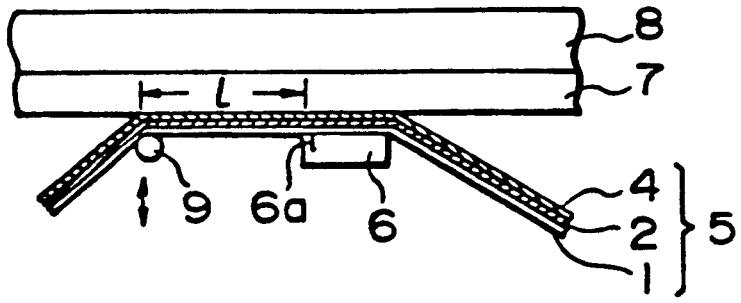
FIGS. 5 and 6 are similar plan views for illustrating a mode wherein the transfer medium is peeled off from the recording medium after a prescribed period after heating.
Figure 6:
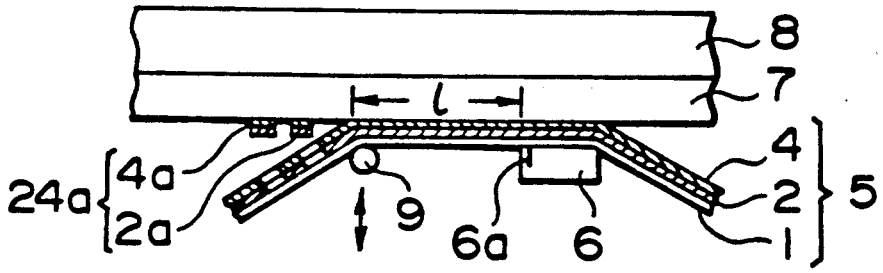

FIGS. 5 and 6 are sectional views taken in the thickness direction of the transfer medium for illustrating a mode of operation wherein both the first ink layer 2 and the second ink layer 4 are transferred. FIG. 5 shows a state before recording, which is different from the state shown in FIG. 3 in that the transfer medium, after heating, runs without additional operation for some length l while being in contact with the recording medium 7 by the action of a pressing member 9 and then is peeled off. The member 9 is, for example, disposed on a carriage (not shown) of a heat-sensitive transfer recording apparatus. The member 9 moves in association with the thermal head 6 while retaining a distance l, from the head, and can be moved, as desired, toward and away from the transfer medium 5. More specifically, when the pressing member 9 is moved away, the transfer medium 5 is peeled off from the recording medium, immediately after the thermal head has passed by as shown in FIG. 3. In contrast, when the member 9 is pushed toward the transfer medium as shown in FIG. 5, the transfer medium 5 is kept in contact with the recording medium 7 for some time after the thermal head has passed by to give a longer period from the time when a heat energy is applied to the transfer medium 5 until the time when the transfer medium 5 is peeled off.

FIG. 6 shows a state after the recording. The thermal head 6 has passed away in the right direction after heat application, and the transfer medium 5 is wound up about a reel (not shown) whereby the transfer medium 5 is peeled off from the recording medium 7 just after it has passed through the member 9 to leave black images 24*a* which are a combination of the first and second ink layers 2*a* and 4*a* both transferred on the recording medium 7.

Figure 7:
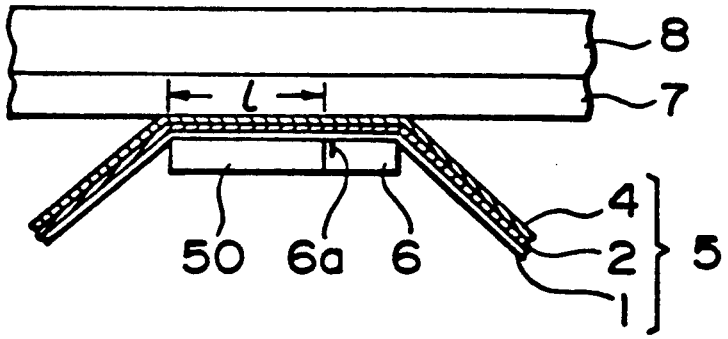
FIG. 7 is a similar plan view showing another operation mode according to the invention.

FIG. 7 is a similar sectional view illustrating another embodiment. FIG. 7 illustrates a mode wherein a black image is obtained. The embodiment shown in FIG. 7 is different from the embodiment explained with reference to FIGS. 5 and 6 in that a member 50 with a length l for keeping the contact between the transfer medium 5 and the recording medium 7 for the length l after heating by the thermal head 6 is detachably integrated with the thermal head 7. In this embodiment, in order to obtain black and red images, two types of thermal heads are used respectively by exchange, or otherwise only the member 50 may be attached or detached to obtain two color images. Further, the member 50 may be disposed so that it moves toward and away from the transfer medium 5, like the member 9 shown in FIG. 4.

The heat-sensitive transfer medium according to the present invention can contain a silicone oil or a fluorine-containing surfactant in at least one of the first ink layer and the second ink layer. The silicone oil or fluorine-containing surfactant has a function of improving the separation performance of the first or the second ink layer containing it.

Examples of the silicone oil used for this purpose include: so-called pure silicone oils such as dimethyl silicone oil, methyl phenyl silicone oil, and methyl hydrogen silicone oil; and modified silicone oils such as polyorganosiloxanediol, chloro phenyl silicone oil, chloro silicone oil, silicone polyether copolymer, alkyl-modified silicone oil, higher fatty acid-modified silicone oil, amino-modified silicone oil, and epoxy-modified silicone oil. Further, examples of the fluorine-containing surfactant include perfluoroalkylcarboxylic acid salts, perfluoroalkylsulfonic acid salts, perfluoroalkylphosphoric acid esters, perfluoroalkylmethylammonium salts, perfluoroalkylamine oxides, perfluoroalkyl-E.O.-adducts, perfluoroalkyl-quaternary ammonium iodides, perfluoroalkyl-polyoxylethylene-ethanol, perfluoroalkylbetaines, and fluorinated alkyl esters.

The silicone oil or fluorine containing surfactant may preferably be contained in at least one of the ink layers in a proportion of 50 ppm to 10%. If the content is below 50 ppm, the effect of addition is little. On the other hand, the addition in excess of 10% results in a poor adhesion with the support when it is contained in the first ink layer 2 or a poor characteristic when it is contained in the second ink layer 4. Further, when the silicone oil or fluorine-containing surfactant is contained in both the first and second ink layers, it should preferably be contained in a proportion of 50 ppm to 10% with respect to the whole ink layers.

Figure 8:
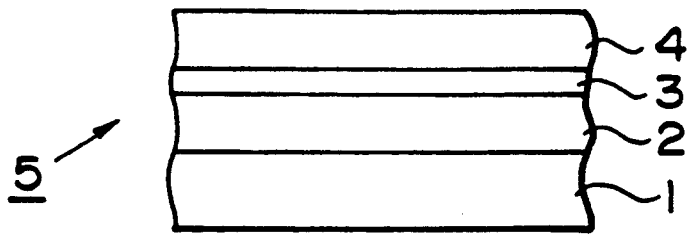
FIGS. 8 to 10 are sectional views respectively showing another embodiment of the heat-sensitive transfer medium according to the invention.

FIG. 8 shows a laminar structure of another embodiment of the heat-sensitive transfer medium according to the present invention. The transfer medium shown in FIG. 8 comprises a support 1, and a first ink layer 2, an adhesive layer 3 and a second ink layer 4 disposed in this order on the support 1. In order to provide relative adhesions as shown in FIG. 2(*a*) to the embodiment shown in FIG. 8, the adhesive layer 3 is composed of a material having an adhesion or cohesion extensively varying on temperature change so that the adhesion sharply decreases on temperature increase due to heating by a thermal head. As a result, the adhesion between the first ink layer 2 and the second ink layer 4 is weaker than the adhesion between the first ink layer 2 and the support 1, at a time immediately after heating and before the temperature being lowered.

On the other hand, in order to provide relative adhesions as shown in FIG. 2(*b*), the first ink layer 2 is composed of a material having a large change in adhesion on temperature change while the adhesive layer 3 is composed of a material having a relatively small change in adhesion on temperature change. As a result, if the transfer medium is peeled off from a recording medium at a time $t_1$, i.e., immediately after heating, both the first ink layer 2 and the second ink layer 4 are transferred, whereas if the transfer medium is peeled off after a little while at a time $t_2$, only the second ink layer is transferred.

Figure 9:
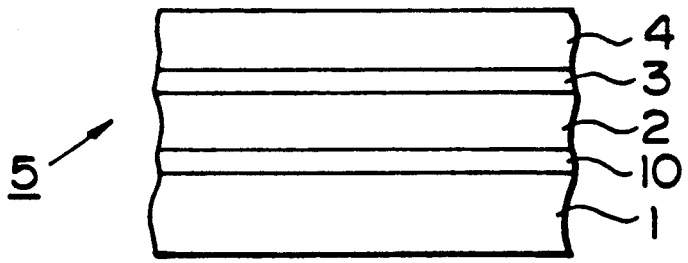

FIG. 9 shows still another embodiment of heat-sensitive transfer medium according to the invention. The transfer medium shown in FIG. 9 comprises a support 1, and a first adhesive layer 10, a first ink layer 2, a second adhesive layer 3 and a second ink layer 4 disposed in this order on the support 1.

In the heat-sensitive transfer medium shown in FIG. 9, the relative adhesion between the first ink layer 2 and the second ink layer 4 the one between the first ink layer 2 and the support 1 are not different from those in the transfer medium shown in FIG. 1. More specifically, if the second adhesive layer 3 is composed of a material showing a large change in adhesion on temperature change, the strength of the adhesive layer 3 sharply decreases as the temperature of the adhesive layer 3 increases on heating by a thermal head, whereby relative adhesions as shown in FIG. 2(*a*) are obtained. In contrast thereto, if the first adhesive layer 10 is composed of a material showing a large change in adhesion on temperature change and the second adhesive layer 3 is composed of a material showing a relatively small change in adhesion on temperature change, the relative adhesions between the layers are as shown in FIG. 2(*b*).

Figure 10:
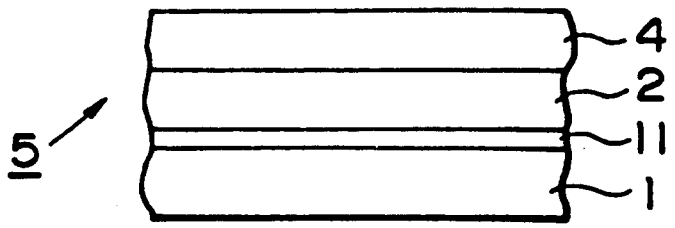

FIG. 10 shows a further embodiment of heat-sensitive transfer medium according to the invention. The transfer medium shown in FIG. 9 comprises a support 1, and a first adhesive layer 11, a first ink layer 2, and a second ink layer 4, disposed in this order on the support 1.

In the embodiment shown in FIG. 10, the relationship between the adhesion between the first ink layer 2 and the second ink layer and the adhesion between the first ink layer 2 and the support is not different from that in the embodiment shown in FIG. 1. More specifically, if the second ink layer 4 is composed of an ink showing a large change in adhesion on temperature change, the adhesion of the second ink layer 4 to the first ink layer 2 sharply decreases as the temperature of the second ink layer 4 increases on heating by a thermal head, whereby relative adhesions as shown in FIG. 2(*a*) are obtained. To the contrary, if the first adhesive layer 11 is composed of a material showing a large change in adhesion on temperature change and the second ink layer 4 is composed of an ink showing a relatively small change in adhesion to the first ink layer 2, relative adhesions as shown in FIG. 2(*b*) are obtained.

The structures and compositions of the embodiments shown in FIGS. 8 to 10 will be described in more detail.

The second ink layer 4 should preferably contain 1 to 80%, particularly 1 to 50%, of a colorant and have a softening temperature within the range of 60° to 180° C. A softening temperature below 60° C. results in a poor storability and is not preferred. A softening temperature above 180° C. provides a poor heat sensitivity and is not preferred.

On the other hand, the first ink layer 2 in the embodiments shown in FIGS. 8 to 10 can contain up to 90%, preferably 1 to 80%, of a colorant for providing the relative adhesions shown in FIG. 2(*a*), while it should preferably contain 1 to 50% of a colorant in order to provide the relative adhesions shown in FIG. 2(*b*).

The embodiment shown in FIG. 8 will specifically be described hereinbelow.

In the case of providing the relative adhesions shown in FIG. 2(*a*), the first ink layer 2 should preferably be heat-fusible but can be adhesive or tacky at room temperature, can have a remarkably high softening temperature or can be one lacking a fusibility. On the other hand, the adhesive layer 3 is generally preferred to have a softening temperature of 60° to 180° C. in the case of providing the relative adhesions shown in FIG. 2(*a*).

In the case of providing the relative adhesions shown in FIG. 2(*a*), it is preferred that the adhesive layer 3 and the second ink layer 4 are so composed as to provide a melt viscosity (by a rotary viscometer) as an ink constituting each layer inclusive of various additives in the range of 10 cps. to 1,000,000 cps. at a temperature which is 30° C. higher than the softening temperature of the respective layers. Particularly, the second ink layer 4 should preferably have a melt viscosity of 200 cps or higher at the above specified temperature in order to provide a good adhesion onto a recording medium such as paper. Further, the adhesive layer 3 should preferably have a melt viscosity lower than that of the second ink layer 4, respectively, at a temperature which is 30° C. higher than the softening temperature of the second ink layer 4. By satisfying these conditions, when the transfer medium is peeled off at time $t_1$ as shown in FIG. 2(*a*), a cohesive failure of the second ink layer 4, i.e., a separation within the second ink layer itself, is less liable to occur, whereby good images can be obtained.

In the mode of FIG. 2(*a*) wherein only the second ink layer 4 is transferred when the heat-sensitive transfer medium is peeled off from the recording medium, the adhesive layer 3 should preferably be so composed as to provide a softening temperature which is equal to or lower than that of the second ink layer 4. When a recording is conducted by a thermal head, the trailing end portion of the image portion in the moving direction of the thermal head changes from a printing temperature to a non-printing temperature. However, during this course of cooling, the ink layers necessarily pass the state of showing the relative adhesions at the time $t_2$ shown in FIG. 2(*a*). For this reason, if the second ink layer 4 is attached to the recording medium while the strength of the adhesive layer 3 is still relatively high, the first ink layer 2 can be transferred along with the second ink layer 4 to unintentionally provide the color of the first ink layer 2 at the trailing end portion of the image portion. This phenomenon can be prevented by setting the softening temperature of the adhesive layer 3 to be equal to or lower than that of the second ink layer 4.

The relative adhesions shown in FIG. 2(*b*) may be obtained by reversing the relative properties of the first ink layer 2 and the adhesive layer 3 from those described above.

The embodiment shown in FIG. 9 will specifically be explained hereinbelow.

The first ink layer 2 should preferably be heat-fusible but can be adhesive or tacky at room temperature, can have a remarkably high softening temperature or can be one lacking fusibility like an inorganic pigment layer as far as it can be transferred. A colorant can be contained, for example, from 1 to 90%. Further the first ink layer can also be formed as a layer consisting only of a colorant, e.g., by vapor deposition.

Further, in order to provide the relative adhesions as shown in FIG. 2(*a*), the first adhesive layer 10 may be one having characteristics similar to those of the first ink layer 2 as described above. However, the first adhesive layer 10 need not contain a colorant. It is generally suitable that the second adhesive layer 3 have a softening point of 60° to 180° C.

In the case of providing the relative adhesions shown in FIG. 2(*a*), it is preferred that the second adhesive layer 3 and the second ink layer 4 are so composed as to provide a melt viscosity (by a rotary viscometer) as an ink constituting each layer inclusive of various additives in the range of 10 cps. to 1,000,000 cps. at a temperature 30° C. higher than the melting temperature of the respective layers. Further, the second adhesive layer 3 should preferably have a melt viscosity lower than that of the second ink layer 4 respectively at a temperature 30° C. higher than the softening temperature of the second ink layer 4. By satisfying these conditions, when the transfer medium is peeled off at time $t_1$ as shown in FIG. 2(*a*), a cohesive failure of the second ink layer 4 is less liable to occur, whereby good images can be obtained.

In the mode of FIG. 2(*a*) wherein only the second ink layer 4 is transferred when the heat-sensitive transfer medium is peeled off from the recording medium at time $t_1$, the second adhesive layer 3 should preferably be so composed as to provide a softening temperature which is equal to or lower than that of the second ink layer 4.

The relative adhesives shown in FIG. 2(*b*) may be obtained by reversing the relative properties of the first adhesive layer 10 and the second adhesive layer 3 as described above.

The embodiment shown in FIG. 10 will specifically be described.

The first ink layer 2 should preferably be heat-fusible but can be adhesive or tacky at room temperature, can have a remarkably high softening temperature or can be one lacking fusibility like an inorganic pigment layer as far as it can be transferred. The first ink layer 2 may contain about 1 to 90% of a colorant or may solely be composed of a colorant formed by, e.g., vapor deposition.

Further, in order to provide the relative adhesions as shown in FIG. 2(*a*), the adhesive layer 11 may be one having characteristics similar to those of the first ink layer 2 as mentioned above. However, the adhesive layer 11 need not contain a colorant.

It is preferred that the second ink layer 4 is so composed as to provide a melt viscosity (by a rotary viscometer) as an ink constituting the layer inclusive of various additives in the range of 10 cps. to 1,000,000 cps. at a temperature 30° C. higher than the softening temperature thereof. Particularly, the second ink layer 4 should preferably have a melt viscosity of 200 cps. or higher at the above specified temperature in order to provide a good adhesion onto a recording medium such as paper.

In order to provide the relative adhesions shown in FIG. 2(*b*), the adhesive layer 11 may be composed to have characteristics similar to those of the second ink layer 4.

In the heat-sensitive transfer medium according to the present invention inclusive of the embodiments shown in FIGS. 8 to 10, the total thickness of the ink layers on the support 1 (i.e., all the layers other than the support 1 inclusive of the adhesive layers) may desirably be 20μ or less. Further, each of the first ink layer, the second ink layer and the adhesive layers should have a thickness in the range of 0.5 to 10μ.

It is desirable that the materials constituting the first ink layer 2 and the second ink layer 4 should be mutually incompatible with each other. This is because the adhesive layer 3 disposed between the first ink layer 2 and the second ink layer 4 can be crushed by pressing due to a thermal head so as to provide a partial contact between the first ink layer 2 and the second ink layer 4, and in such a case, the two-color separation is better retained by using mutually incompatible materials for the ink layers.

As a further modification, it is also effective to provide a heat resistant layer on the back surface of the support 1 or between the support 1 and the first ink layer 2. It is also effective to provide a layer for increasing an adhesion onto a recording medium on the second ink layer 4. Further, a various functional layer may be disposed as desired between the respective layers or on the surface. The functional layer can contain a colorant.

As one effective example, such a functional layer containing a colorant may be provided as a layer showing a tranferability when it is applied with a higher heat energy than the first and second ink layers so that it is transferred after the first and second ink layers to provide an additional color thereof onto the recording medium. Alternatively, a functional ink layer showing a transferability when applied with a pressure may be used so as to provide a similar effect.

As a heating means for heat-sensitive transfer recording, ordinary heat sources such as infrared rays and laser beam may also be used in place of a thermal head. Further, in order to provide a conduction heating system, i.e., a system wherein a heat-sensitive transfer medium itself generates a heat due to a current passing therethrough, a thin layer of a conductive material such as aluminum may be disposed as a return electrode between the support and the first ink layer.

The first ink layer 2, the second ink layer 4 and adhesive layers 3, 10 and 11 may be formed by using one more binders selected from the following class and adding thereto a colorant and other additives as desired. The binder may be selected from natural waxes such as whale wax, beeswax, lanolin, carnauba wax, candelilla wax, montan wax and ceresin wax; petroleum waxes such as paraffin wax and microcrystalline wax; synthetic waxes such as oxidized wax, ester wax, low molecular weight polyethylene, Fischer-Tropsch wax and the like; higher farry acids such as lauric acid, myristic acid, palmitic acid, stearic acid, and behenic acid higher alcohols such as stearyl alcohol and behenyl alcohol; esters such as fatty acid esters of sucrose and fatty acid esters of sorbitane; amides such as stearamide and oleic amide; thermoplatic resins including: homopolymers of styrene and substituted styrenes such as polystyrene, poly-p-chlorostyrene, and polyvinyltoluene; styrene copolymers such as styrene-p-chlorostyrene copolymer, styrene-propylene copolymer, styrene-vinyltoluene copolymer, styrene-vinylnaphtalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-chloromethyl methacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-acrylonitrile indene copolymer, styrene maleic acid copolymer, and styrene-maleic acid ester copolymer; polymethyl methacrylate, polybutyl methacrylate, polyvinyl chloride, polyvinyl acetate, polypropylene, polyester, polyurethane, polyamide, epoxy resin, polyvinyl butyral, polyacrylic acid resin, rosin, modified rosin, terpene resin, phenolic resin, aliphatic and alicyclic hydrocarbon resins, aromatic petroleum resin, cellulose resin; elastomers such as natural rubber, styrene-butadiene rubber, isoprene rubber and chloroprene rubber; polyisobutylene, or polybutene; homopolymers and copolymers of olefin such as polyethylene, polypropylene, polyisobutylene, polyethylene wax, oxidized polyethylene, polytetrafluoroethylene, ethylene-acrylic acid copolymer, ethylene-ethyl acrylate copolymer and ethylene-vinyl acetate copolymer; and derivatives of these polymers.

The colorant may be selected from all of the known dyes and pigments including: carbon black, Nigrosine dyes, lamp black, Sudan Black SM, Alkali Blue, Fast Yellow G, Benzidine Yellow, Pigment Yellow, Indo Fast Orange, Irgadine Red, Paranitroaniline Red, Toluidine Red, Carmine FB, Permanent Bordeaux FRR, Pigment Orange R, Lithol Red 20, Lake Red C, Rhodamine FB, Rhodamine B Lake, Methyl Violet B Lake, Phthalo-cyanine Blue, Pigment Blue, Brilliant Green B, Phthalocyanine Green, Oil Yellow GG, Zapon Fast Yellow CGG, Kayaset Y963, Kayaset YG, Smiplast Orange G, Orasol Brown B, Zapon Fast Scarlet CG, Aizen Spiron Red BEH, Oil Pink OP, Victoria Blue F4R, Fastgen Blue 5007, Sudan Blue, and Oil Peacock Blue. Further, metal powder such as copper powder and aluminum powder or powder of mineral such as mica may also be used as a colorant. Further, other additives such as plasticizers, mineral oils, vegetable oils, etc., may also be added.

The ink layers and adhesive layers shown in FIGS. 8 to 10 having the desired properties as described with reference to the figures including the relative adhesions as shown in FIG. 2(*a*) or 2(*b*), may be obtained by appropriately controlling the properties such as molecular weights, crystallinities, etc., of the above mentioned materials or appropriately mixing a plurality of the above mentioned materials.

Figure 11:
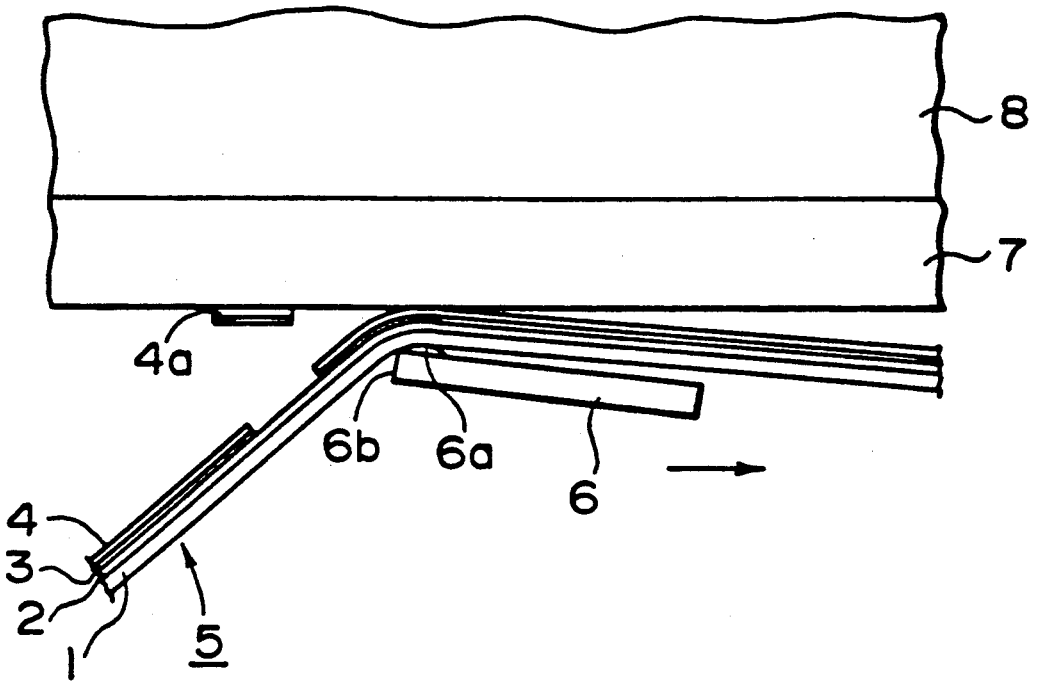
FIG. 11 is a plan view similar to FIG. 4 for illustrating a mode wherein a transfer medium according to the invention is peeled off from a recording medium immediately after heating.
Figure 12:
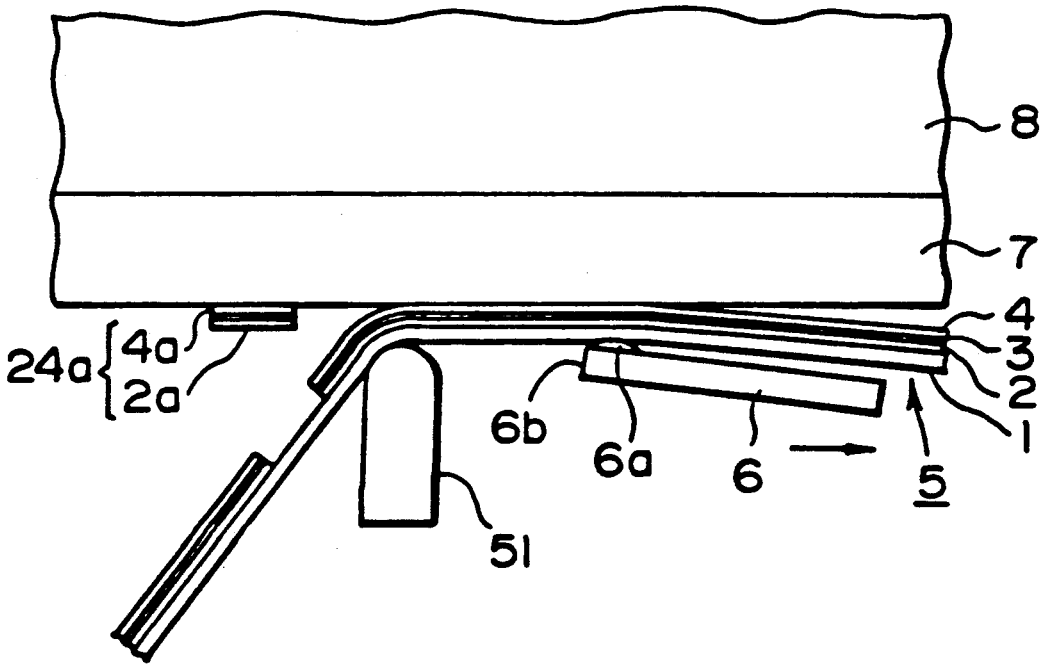
FIG. 12 is a plan view similar to FIG. 5 for illustrating a mode wherein the transfer medium is peeled off from the recording medium after a prescribed period after heating.

The heat-sensitive transfer medium according to the invention may be obtained by forming the respective layers by mixing the materials constituting the respective layers and an organic solvent such as methyl ethyl ketone, xylene and tetrahydrofuran capable of dissolving the binders and applying the thus formed coating liquids successively on the support. Alternatively, the so-called hot-melt coating method may be adopted, including the steps of blending, hot-melting and applying the materials in a molten state for the respective layers. The materials for the respective layers may be formed into aqueous emulsions by the addition of a dispersant such as a surfactant, and the aqueous emulsions may be applied to form the respective layers. Further, the respective layers of the transfer medium may also be formed by using the above mentioned coating methods in combination, i.e., by using different methods for the respective layers. A heat-sensitive transfer recording method using heat-sensitive transfer media shown in FIGS. 8–10 will now be described while referring to FIGS. 11 and 12. The heat-sensitive transfer recording method is not substantially different from the one explained with reference to FIGS. 3–7. In FIGS. 11 and 12, a thermal head 6 is more specifically shown than the thermal head 6 in FIGS. 3–7, apparently with a different shape and a different angle of disposition, but is not substantially different from the latter. In FIGS. 11 and 12, a heat-sensitive transfer medium 5 showing the relative adhesions as shown in FIG. 2(*a*) is shown as an example.

In this embodiment, the first ink layer 2 is colored in black and the second ink layer 4 is colored in red. FIG. 11 shows a state after recording. The thermal head 6 has passed in the right direction and the transfer medium 5 is wound up about a reel (not shown), whereby the transfer medium 5 is peeled off from the recording medium 7 just after it has passed through the heater portion 6*a* of the thermal head 6. The instant immediately after the peeling-off corresponds to the time $t_1$ in FIG. 2(*a*). As a result, a red image 4*a* is obtained on the recording medium 7.

FIG. 12 is a sectional view taken in the thickness direction of the transfer medium for illustrating a mode of operation wherein both the first ink layer 2 and the second ink layer 4 are transferred. This mode is different from the one explained in FIG. 11 in that the transfer medium 5, after heating, runs without additional operation for some length 1 while being in contact with the recording medium 7 by the action of a pressing member 51 and then is peeled off. The member 51 is, for example, disposed on a carriage (not shown) of a heat-senitive transfer recording apparatus. The member 51 moves in association with the thermal head 6 while retaining a distance 1 from the head 6, and can be moved, as desired, toward and away from the transfer medium 5. More specifically, when the pressing member 51 is moved away, the transfer medium 5 is peeled off immediately after the thermal head 6 has passed by as shown in FIG. 11. On the other hand, when the member 51 is pushed toward the transfer medium as shown in FIG. 12, the transfer medium 5 is kept in contact with the recording medium 7 for some time after the thermal head has passed by to give a longer period from the time when a heat energy is applied to the transfer medium 5 until the time when the transfer medium 5 is peeled off.

FIG. 12 shows a state after the recording. The thermal head 6 has passed away in the right direction after heat application, and the transfer medium 5 is wound up about a reel (not shown), whereby the transfer medium 5 is peeled off from the recording medium 7 immediately after it has passed by the member 51 to leave black images 24*a* through transfer of both the first ink layer 2 and the second ink layer 4.

The above explained heat-sensitive transfer recording method is carried out in substantially the same way even if a heat-sensitive transfer medium having the characteristics as shown in FIG. 2(*b*) is used. In this case however, both the first ink layer 2 and the second ink layer 4 are transferred onto the recording medium 7 if the transfer medium is peeled off immediately after heating by a thermal head, while only the second ink layer 4 is transferred if the transfer medium is peeled off a little time after heating.

Further, by using the heat-sensitive transfer medium and the recording method according to the present invention, both recording and erasure operations can be effected by the use of a heat-sensitive transfer medium. More specifically, in this case, either one of a first ink layer and a second ink layer is made a white ink layer, and the other ink layer is made a colored layer containing a colorant. Then, a transferred image (a recorded image) is covered by the white ink layer transferred by the above described recording method, whereby the transferred image on the recording medium can be erased.

The pigment to be contained in the white ink layer is most suitably titanium dioxide because of excellent hiding power but may be zinc white, lithopone or the like. Further, calcium carbonate, magnesium carbonate, silicon dioxide, etc., as a body can be used in combination. The pigment may suitably be contained in a proportion of 2 to 80% of the white ink layer.

In the heat-sensitive transfer recording method according to the present invention, it is possible to use a transfer medium having a layer of fine powder which is not fused at a heat energy for recording between the first and second ink layers. The fine powder layer has a function of improving the separation between the first and second ink layers. The fine powder may comprise silicic acid anhydride, silicates, alumina, alumina hydrate, etc. in the form of particle having sizes of 400 mμ or smaller. If the particle size exceeds 400 mμ, a dense layer cannot be formed so that a function of binding the first and second ink layers is liable to be not exhibited during non-recording time. The thickness of the fine powder layer should preferably be 0.01 to 2μ, particularly 0.1 to 1.5μ. If the thickness is less than 0.01μ, the separation improving effect is not sufficient, while the thickness above 2μ can invite the dropping due to peeling of a second ink layer 4 during non-recording time.

Now, the heat-sensitive transfer recording apparatus for practicing the above mentioned heat-sensitive transfer recording method will be described.

Figure 13:
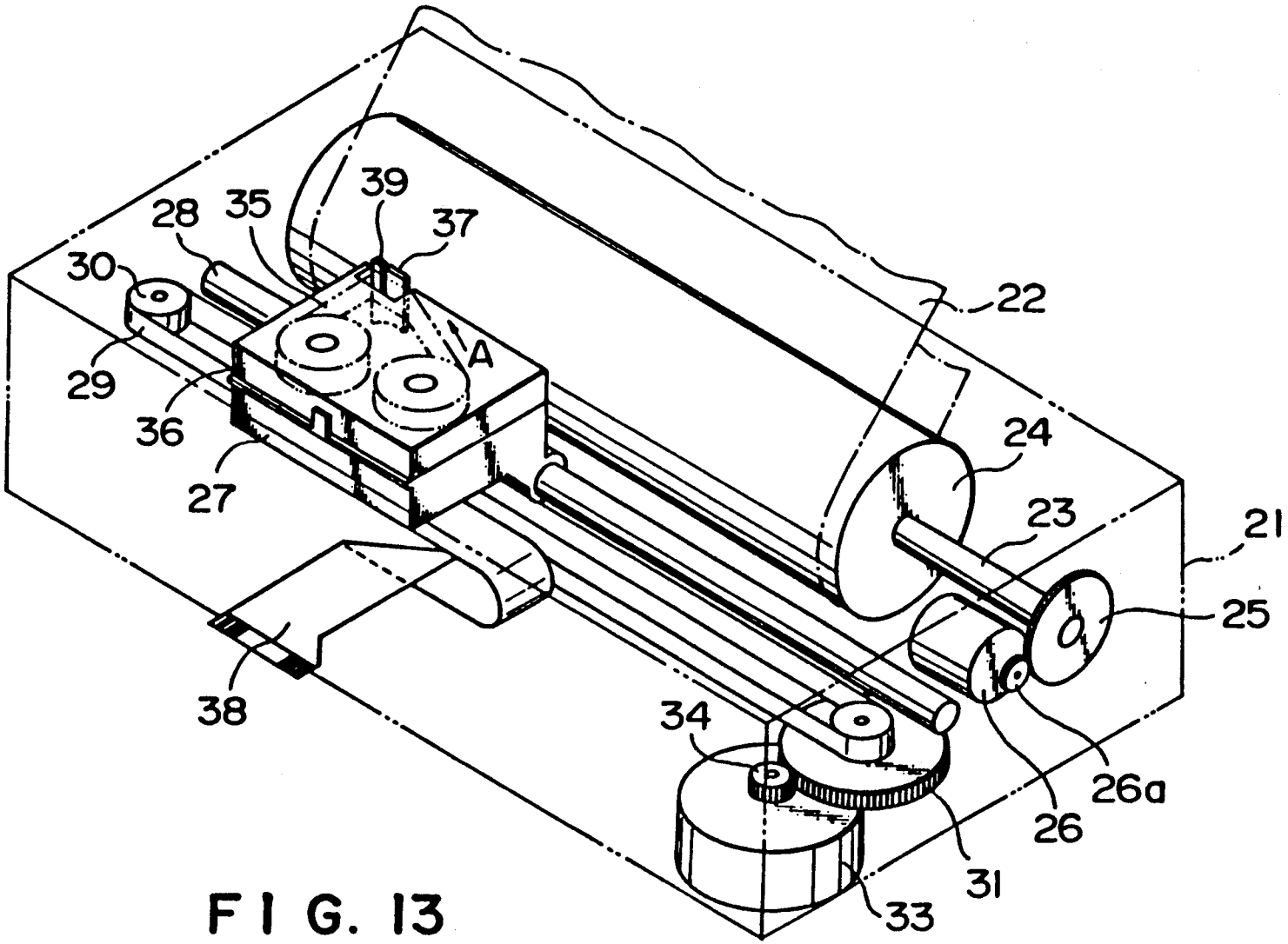
FIG. 13 is a perspective view showing an essential part of an embodiment of the heat-sensitive transfer recording apparatus according to the invention.

FIG. 13 is a perspective view showing a general feature of an embodiment of the heat-sensitive transfer recording apparatus (hereinafter referred to as "thermal transfer printer") 21, composed in the following manner. Recording paper 22 as a recording medium is wound up about a cylindrical platen 24 of an elastic material such as neoprene rubber disposed on a shaft 23 and fed according to the revolution of the platen 24. At one end of the shaft 23 is mounted a paper feed gear 25 which is engaged with a driving gear 26*a* of a paper feed pulse motor 26. The paper feed pulse motor 26 rotates upon input of pulses to rotate the platen 24 in forward and backward directions, whereby the paper 22 is fed at a prescribed rate.

Figure 14:
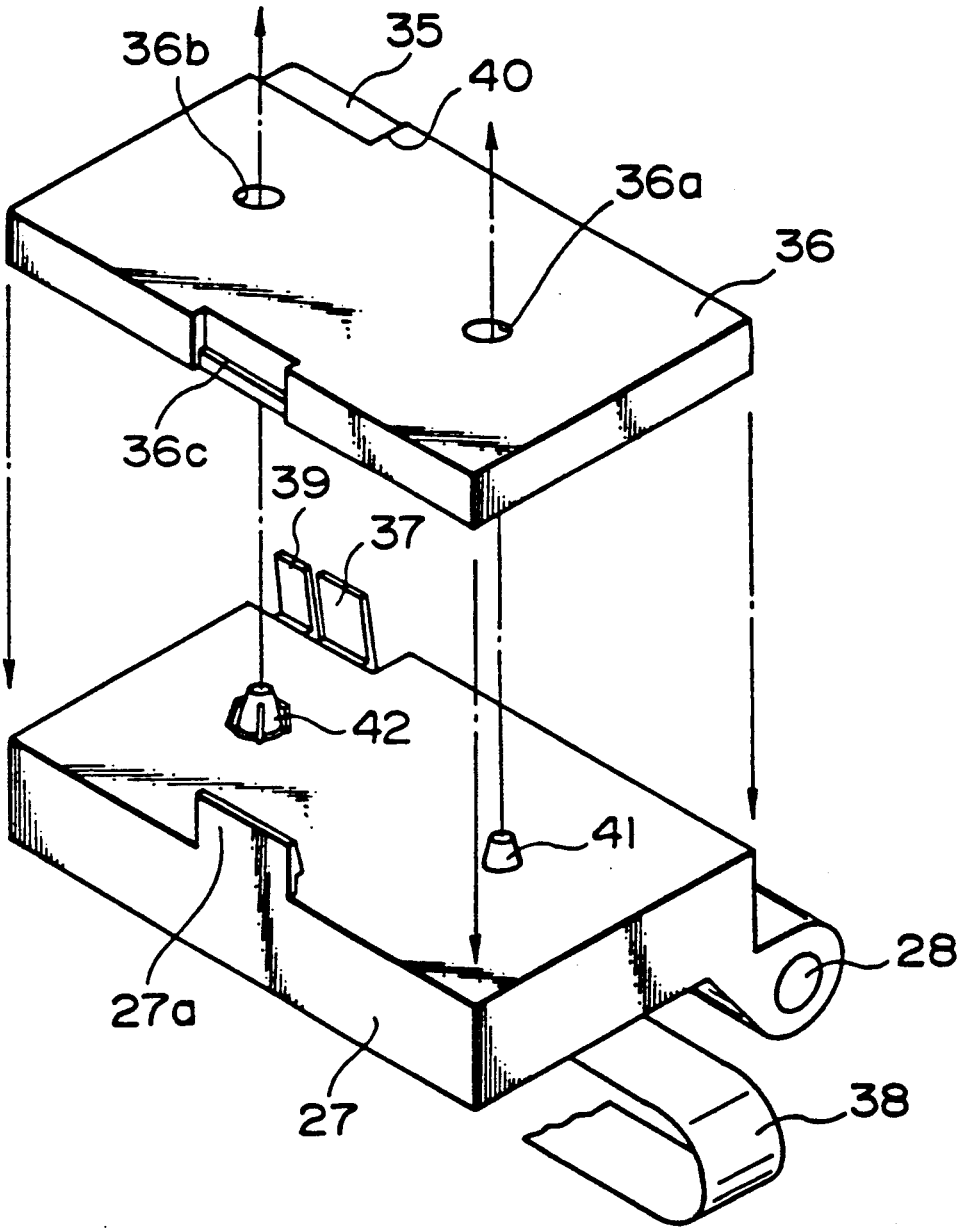
FIG. 14 is a perspective view of an example of a carriage and a cassette case used in the heat-sensitive transfer recording apparatus according to the invention.

A line-changing operation is carried out by exciting the paper feed pulse motor 26. A carriage 27 is slidably mounted on a shaft 28 inserted therethrough so that it can be slided leftward and rightward. The carriage 27 is connected to a timing belt 29. The timing belt 29 is rotatably wrapped around a pulley 30 and a gear 31. The gear 31 is engaged with a driving gear 34 of a pulse motor 33. Thus, the carriage 27 can be moved leftward and rightward by the revolution of the pulse motor 33 and by the medium of the timing belt 29. On the carriage 27 is detachably disposed a ribbon cassette in which an ink ribbon 35, which is a heat-sensitive transfer medium prepared in the form of a ribbon, is disposed like a reel as in an audio cassette tape. The carriage 27 is further provided with a pressing member 39 which is disposed in parallel with a thermal head 37. The carriage 27 is placed on a farther side from the recording paper 27 with respect to the thermal head 37, i.e., a side to which the ink ribbon 35 is peeled off from the paper 22. The pressing member 39 corresponds to the pressing member 9, 50 or 51 shown in FIG. 5, 7 or 12. The pressing member 39 is constituted so that it is moved by a driving signal toward and away from the platen 24. When the pressing member 39 is moved toward the platen 24, the transfer medium 35 contacts the recording paper 22 so that the timing when the transfer medium 35 is peeled off from the recording paper 22 is delayed. The shape of the pressing member 39 is not limited to a plate as shown in FIGS. 13 and 14 but may also be a cylinder or bar. The thermal head 37 is also disposed in the carriage 27 and supplies a thermal energy to the ink ribbon 35 from the back side thereof by receiving an input signal supplied through a flexible bus 38.

Then, the outline of the recording operation will be described. When a prescribed recording signal is supplied, the pulse motor 33 is excited and begins to rotate so that the carriage 27 starts to move in the right direction in the figure. Then, when an input signal is supplied through the flexible bus 38, a heat generating member (not shown) disposed on the surface of the thermal head 37 evolves a thermal energy to heat the heat-transferable ink on the ink ribbon 35 and transfer the ink onto the recording paper 22, whereby a transferred image is formed thereon. When one line of recording is completed by repeating the above operations, after the carriage is moved further in the right direction by a length corresponding to the width of the pressing member 39, the pulse motor 39 reversely rotates to move the carriage leftward and excite the paper feed pulse motor 26, whereby the platen 24 is rotated to feed the paper 22 by a prescribed amount.

As the carriage moves rightward, the ink, ribbon 35 in the ribbon cassette is caused to rotate in the direction of an arrow A, whereby a fresh part of the ink ribbon 35 is always supplied to the thermal head 37 and the used ink ribbon is wound up in the ribbon cassette 36.

FIG. 14 shows the appearance of the ribbon cassette case 36 in which the heat-sensitive transfer medium according to the invention and the carriage 27 in which the cassette case 36 is detachably disposed. The transfer medium 35 is stored in the form of being wrapped about two pulleys 36*a* and 36*b* in the cassette case 36 and is exposed to the exterior through an opening 40 formed at a part of the cassette case 36. The carriage 27 is provided with a hooking member 27*a*, so that when the cassette 36 is disposed in the carriage 27, the hooking member 27*a* effects an engagement with an engaging groove 36*c* formed on the cassette case 36. The carriage 27 is also provided with a spindle 41 and a driving spindle 42 which are inserted in the pulleys 36*a* and 36*b*, respectively, of the cassette case 36. The driving spindle 42 is rotated by a driving source (not shown) provided in the carriage 27, whereby if the cassette 36 is disposed in the carriage 27, a fresh transfer medium 35 is always supplied to the opening 40 and the used transfer medium 35 is wound up about the pulley 36*b*. The thermal head 37 is disposed so that it can be moved toward and away from the recording paper 22 like the pressing member 39. The flexible bus 38 is used for supplying recording signals to the thermal head 37, for supplying controlling signals to the internal driving source in the carriage 27 and for supplying a power.

The thermal head 37 and the pressing member 39 are respectively moved independently by the action of solenoids (not shown) provided in the carriage 27. When the transfer medium is peeled off at time $t_1$ in FIGS. 2(*a*) and 2(*b*), only the thermal head 37 is pressed toward the recording paper 22 to effect recording, and when the transfer medium is peeled off at time $t_2$, both the thermal head 37 and the pressing member 39 are pressed toward the recording paper 22. During the non-recording period, both are moved away from the recording paper 22.

As described hereinabove, according to the present invention, two-color images can be selectively obtained by a single heat-sensitive transfer medium only by changing the time after heat application until the peeling-off of the transfer medium thereby to make beautiful images on a recording medium such as plain paper. Particularly when an embodiment of the transfer medium according to the invention having an adhesive layer between the first and second ink layers is used, the separation between the first and second ink layers can be effected at the adhesive layer, whereby the ink layers can be transferred while retaining the integrity of the layers thereof. As a result, even on a paper having a relatively low surface smoothness, beautiful transferred image with little blur or scratch can be obtained. Further, when an embodiment of the transfer medium having an adhesive layer between the first ink layer and the support is used, the first ink layer can be transferred with good integrity, whereby the color or hiding power thereof can be fully exhibited on the transferred second ink layer. Further, when either one of the first and second ink layers is made a white ink layer and the heat-sensitive transfer recording method according to the invention is applied, correction of wrong or error images can be effectively conducted.

Hereinbelow, the present invention will be explained more specifically while referring to specific examples of practice. Incidentally, the number-average molecular weight of a sample such as oxidized polyethylene was measured in the following manner.

Molecular Weight Measurement

The VPO method (Vapor Pressure Osmometry Method) is used. A sample polymer is dissolved in a solvent such as benzene at various concentrations (C) in the range of 0.2 to 1.0 g/100 ml to prepare several solutions. The osmotic pressure ($\pi/C$) of each solution is measured and plotted versus the concentration to prepare a concentration (C)-osmotic pressure ($\pi/C$) curve, which is extrapolated to obtain the osmotic pressure at the infinite dilution $(\pi/C)_0$. From the equation of $(\pi/C)_0 = RT/Mn$, the number average molecular weight Mn of the sample is derived.

EXAMPLE 1

A terpene-phenol copolymerization resin (polycondension product of terpenes consisting mainly of $\alpha$-pinene and $\beta$-pinene and bisphenol A) in an amount of 10 parts was dissolved in 89 parts of MEK (methyl ethyl ketone) to form a solution, in which was further dissolved 1 part of an oil-soluble red dye to produce a coating composition A for a second ink layer.

Separately, 30 parts of oxidized wax, 10 parts of low-molecular weight polyethylene and 48 parts of paraffin wax were melted by heating and 12 parts of carbon black was further mixed. The mixture was further sand-milled for 30 minutes under heating to disperse the carbon black whereby a coating composition B for a first ink layer was obtained.

The coating composition B was hot-molt-coated by means of a wire bar on a 6 $\mu$-thick PET (polyethylene terephthalate) film to form a 4 $\mu$-thick first ink layer. Then, on the first ink layer, the coating composition A was applied and dried under heating for 3 minutes in an oven at 80° C. to provide a 2 $\mu$-thick second ink layer, whereby a heat-sensitive transfer medium was complete.

The heat-sensitive transfer medium was cut into an 8 mm-wide tape and loaded on a heat-sensitive transfer printer for a Japanese word processor (Canoword 45S, mfd. by Canon K.K.). When the heat-sensitive transfer recording was effected at the maximum heat input level according to the ordinary mode wherein the transfer medium was peeled off immediately after imprinting, clear red images were obtained on a copy paper. Then, the transfer medium was retained in contact with the copy paper for some time after imprinting and then peeled off from the copy paper, whereby clear black images were obtained on the copy paper.

As described, in the above example, clear two-color images can be obtained without changing heat inputs by using laminated ink layers which do not readily mix with each other under heat application, and by changing the timing of separating the transfer medium and a recording medium.

EXAMPLE 2

| <Ink 1> | |
|---|---|
| Oxidized polyethylene aqueous dispersion (Mn = 5000, softening temp. = 140° C., particle size = 1 μm) | 60 parts |
| Ethylene-vinyl acetate copolymer resin aqueous dispersion (softening temp. = 105° C., particle size = 0.5 μm) | 20 parts |
| Carbon black aqueous dispersion | 20 parts |

(The amounts of aqueous dispersions for providing an ink formulation in this example and the other examples are all expressed based their solid contents.)

The above components were sufficiently mixed to prepare an ink 1. The ink 1 was applied on a 6 μ-thick PET (polyethylene terephthalate) film and dried at 70° C. to form a 2 μ-thick first ink layer.

| <Ink 2> | |
|---|---|
| Carnauba wax aqueous dispersion (particle size: 0.5 μm) | 100 parts |
| Silicone surfactant | 0.1 part |

An ink 2 having the above composition was applied on the first ink layer and water was evaporated therefrom to leave a 1 μm-thick adhesive layer of carnauba wax.

| <Ink 3> | |
|---|---|
| Oxidized polyethylene aqueous dispersion (Mn = 2000, softening temp. = 120° C., particle size = 1 μm) | 60 parts |
| Ethylene-vinyl acetate copolymer resin aqueous dispersion (softening temp. = 105° C., particle size = 0.5 μm) | 20 parts |
| Cyanine blue aqueous dispersion | 20 parts |

The above components were sufficiently mixed to prepare an ink 3, which was applied to the above prepared adhesive layer and dried at 70° C. to form a μm-thick second ink layer, whereby a heat-sensitive transfer medium (I) having a structure as shown in FIG. 8 was obtained.

EXAMPLE 3

| <Ink 4> | |
|---|---|
| Hydrogenated resin ester aqueous dispersion (softening temp. = 90° C., particle size = 1 μm) | 80 parts |
| Cyanine blue aqueous dispersion | 20 parts |

Similarly as in Example 2, a first ink layer and an adhesive layer were prepared. Then, an ink 4 having the above composition was applied on the adhesive layer and dried at 80° C. to form a 2 μm-thick second ink layer, whereby a heat-sensitive transfer medium (II) having a structure as shown in FIG. 8 was obtained.

EXAMPLE 4

| <Ink 5> | |
|---|---|
| Oxidized polyethylene aqueous dispersion (Mn = 1800, softening temp. = 104° C., particle size = 1 μm) | 40 parts |
| Ethylene-vinyl acetate copolymer resin aqueous dispersion (softening temp. = 105° C., particle size = 0.5 μm) | 40 parts |
| Carbon black aqueous dispersion | 20 parts |
| <Ink 6> | |
| Polyamide resin aqueous dispersion (softening temp. = 60° C.) | 100 parts |
| Silicone surfactant | 0.1 part |
| <Ink 6A> | |
| Polyamide resin aqueous dispersion (softening temp. = 105° C.) | 80 parts |
| Cyanine Blue aqueous dispersion | 20 parts |

The above components were respectively sufficiently mixed to prepare inks 5, 6 and 6A.

In a similar manner as in Example 2, the ink 5 was used to form a 2 μm-thick first ink layer, the ink 6 was used to form a 2 μm-thick adhesive layer and the ink 6A was used to form a 2 μm-thick second ink layer whereby a heat-sensitive transfer medium (III) having a structure as shown in FIG. 8 was obtained.

EXAMPLE 5

| <Ink 7> | |
|---|---|
| Oxidized polyethylene aqueous dispersion (Mn = 4000, softening temp. = 138° C., average particle size = 1 μm) | 80 parts (solid) |
| Ethylene-vinyl acetate copolymer (softening temp. = 95° C., particle size = 0.5 μm) | 20 parts (solid) |

The above components were sufficiently mixed to prepare an ink 7. An addition type silicone resin for release paper was applied at a rate of 0.3 g/m$^2$ on the back side of a 3.5 μm-thick PET film support and dried at 70° C. to provide a heat-resistant protective layer. The PET film was further coated with the above ink 7 on the reverse side from the protective layer and dried at 70° C. to be provided with a 1.5 μm-thick first adhesive layer.

| <Ink 8> | |
|---|---|
| Polyamide resin aqueous dispersion (softening temp. = 90° C.) | 50 parts (solid) |
| Carbon black aqueous dispersion | 50 parts (solid) |

The above components were sufficiently mixed to prepare an ink 8, which was then applied on the first adhesive layer prepared as described above and dried at 80° C. to form a 2.5 μm-thick first ink layer.

| <Ink 9> | |
|---|---|
| Carnauba wax aqueous dispersion | 100 parts |
| Silicone surfactant | 0.1 part |

The above components were sufficiently mixed to prepare an ink 9, which was then applied on the first ink layer and dried at 80° C. to form a 1.5 μ7-thick second adhesive layer.

| <Ink 10> | |
|---|---|
| Oxidized polyethylene aqueous dispersion (Mn = 2000, softening temp. = 110° C., particle size = 1 μm) | 60 parts (solid) |
| Ethylene-vinyl acetate copolymer resin aqueous dispersion (softening temp. = 105° C., particle size = 0.5 μm) | 40 parts (solid) |
| Cyanine blue aqueous dispersion | 20 parts (solid) |

The above components were sufficiently mixed to prepare an ink 10, which was then applied on the second adhesive layer formed as above and dried to form a 2 μm-thick second ink layer, whereby a heat-sensitive transfer medium (IV) having a structure as shown in FIG. 9.

EXAMPLE 6

| <Ink 11> | |
|---|---|
| Oxidized polyethylene aqueous dispersion (Mn = 5000, softening temp. = 140° C. particle size = 1 μm) | 80 parts (solid) |
| Carbon black aqueous dispersion | 20 parts |
| <Ink 12> | |
| Polyamide resin aqueous dispersion (softening temp. = 80° C.) | 80 parts |
| Cyanine blue aqueous dispersion | 20 parts |

The above components were respectively sufficiently mixed to prepare inks 11 and 12. The above prepared ink 7, ink 11, ink 9 and ink 12 were successively applied and dried respectively on a 6 μm-thick PET film, thereby to obtain a heat-sensitive transfer medium (V) having a structure as shown in FIG. 9.

EXAMPLE 7

| <Ink 13> | |
|---|---|
| Polyamide resin aqueous dispersion (softening temp. = 60° C.) | 100 parts |
| Silicone surfactant | 0.1 part |
| <Ink 14> | |
| Oxidized polyethylene aqueous dispersion (Mn = 5000, softening temp. = 140° C., particle size = 1μ) | 80 parts |
| Carbon black aqueous dispersion | 20 parts |
| <Ink 15> | |
| Oxidized polyethylene aqueous dispersion (Mn = 4000, softening temp. = 138° C., particle size = 1 μm) | 100 parts |
| Silicone surfactant | 0.1 part |

The above components were respectively sufficiently mixed to prepare inks 13, 14 and 15. The above prepared inks 15, 14, 13 and 6A were successively applied and dried on a 3.5 μm-thick PET back-coated as in Example 5, to prepare a heat-sensitive transfer medium (VI) having a structure as shown in FIG. 9.

EXAMPLE 8

| <Ink 16> | |
|---|---|
| Oxidized polyethylene aqueous dispersion (Mn = 4000, softening temp. = 138° C., average particle size = 1 μm) | 80 parts |
| Ethylene-vinyl acetate copolymer resin aqueous dispersion (softening temp. = 95° C., particle size = 0.5 μm) | 20 parts |

-continued

| <Ink 17> | |
|---|---|
| Oxidized polyethylene aqueous dispersion (Mn = 5000, softening temp. = 140° C., particle size = 1 μm) | 80 parts |
| Carbon black aqueous dispersion | 20 parts |
| Fluorine-containing surfactant | 0.1 part |
| <Ink 18> | |
| Carnauba wax aqueous dispersion | 40 parts |
| Terpene-phenol copolymerization resin aqueous dispersion | 40 parts |
| Cyanine blue aqueous dispersion | 20 parts |

The above components were respectively sufficiently mixed to prepare inks 16, 17 and 18. These inks 16, 17 and 18 were successively applied and dried on a 3.5 λm-thick PET back coated as in Example 5 to form a 1.5 μm-thick first adhesive layer, a 2 μm-thick first ink layer and a 2 μm-thick ink layer, wehreby a heat-sensitve transfer medium (VII) having a structure as shown in FIG. 10 was obtained.

EXAMPLE 9

In the same manner as in Example 8, the above prepared inks 15, 14 and 6A were successively applied and dried to prepare a heat-sensitive transfer medium (VIII) having a structure as shown in FIG. 10.

The thus prepared heat-sensitive transfer media (I)-(-VIII) were respectively used for recording by means of a heat-sensitive transfer recording apparatus for an English typewriter (Typestar 6, mfd. by Canon K.K.). As the thermal head, one prepared by Rohm K.K., having a length from the center of the heat generating part 6a to the trailing end 6b (as show in FIG. 11) of 350μ was used. The moving velocity of the carriage loading the thermal head and an ink ribbon was about 50 mm/sec. Accordingly, the time ($t_1$ in FIG. 2) from heating until the peeling-off of the ink ribbon from a recording medium was about 7 msec. in the ordinary transfer recording mode. In order to delay the time of the peeling off, a pressing means 9 was disposed at about 5 mm after the trailing end 6b of the thermal head. As a result, when the pressing member 9 was moved toward the recording medium, the time of peeling-off ($t_2$ in FIGS. 2(*a*) and 2(*b*)) was about 100 msec. after the heating. Incidentally, as a preliminary test, the position of the pressing member was changed in different ways, whereby it was confirmed that the result of the recording was not substantially different from the case where the pressing member was not used, if it was disposed at a position from 2 mm to 20 mm after the trailing end of the thermal head.

Where the transfer recording was conducted on plain paper by the use of the heat-sensitive transfer media (I) and (IV), blue images were obtained when the transfer medium was peeled rapidly and black images were obtained when the transfer medium was peeled at the delayed time. In the blue images obtained by using the transfer medium (I), black spots were very slightly observed, but the images were sufficiently good from a practical point of view.

Where the heat-sensitive transfer media (II), (V) and (VII) were used to make a record on plain paper, blue images were obtained when the transfer medium was peeled off rapidly and black images were obtained when the transfer medium was peeled-off at the delayed time.

The blue images contained almost no black spots and were beautiful.

When the heat-sensitive transfer media (III), (VI) and (VIII) were used to make a record on plain paper, black images were obtained when the transfer medium was peeled-off rapidly and blue images were obtained when the transfer medium was peeled off at the delayed time. The blue images contained very slight black spots but were satisfactory.

EXAMPLE 10

| | |
|---|---|
| Terpene-phenol copolymerization resin | 10 parts |
| Silicone oil (TFS 451-50, mfd. by Toshiba Silicone K.K.) | 0.1 part |

The above components were dissolved in 89 parts of MEK, and 1 part of an oil soluble red dye was further dissolved to prepare a coating composition A1 for a second ink layer.

Oxidized wax in an amount of 30 parts, 10 parts of low molecular weight oxidized polyethylene and 48 parts of paraffin wax were melted under heating, and 12 parts of carbon black was further mixed. The mixture was further sand-milled for 30 minutes under heating to disperse use carbon black to prepare a coating composition B1 for a first ink layer.

The coating composition B1 was hot-melt coated onto a 6 μ-thick PET film by means of a wire bar to form a 4 μ-thick coating. Then, the coating composition A1 was applied on the coating and dried for 3 minutes in an oven at 80° C. to form a 2 μ-thick coating, whereby a heat-sensitive transfer medium was prepared.

The heat-sensitive transfer medium was cut into a 8 mm-wide tape and loaded on a heat-sensitive transfer printer for a Japanese word processor (Canoward 45S). When the heat-sensitive transfer recording was effected at the maximum heat input level according to the ordinary mode wherein the transfer medium was peeled off immediately after imprinting, clear red images were obtained on a copy paper. Then, a pressing member capable of pressing the transfer medium to a copy paper so that the transfer medium was retained in contact with the copy paper for some time, i.e., until the transferable ink layer cooled, and then allowed to be peeled off, was disposed adjacent to the thermal head, and the heat-sensitive transfer recording was conducted in a similar manner, whereby clear black images were obtained on the copy paper.

EXAMPLES 11-13

Heat-sensitive transfer media of Examples 11-13 were respectively prepared in the same manner as in Example 10 except that the separation promoters shown in the following table were used, and evaluated by the heat-sensitive transfer recording method of Example 10.

The results are summarized in the following table.

TABLE

| | Layer containing separation promotor | Kind and amount of separation promotor | Recording method | Evaluation of color separation performance |
|---|---|---|---|---|
| Example 11 | First ink layer | Silicone oil 0.5 part | Same as in Example 10 | ○ |
| Example 12 | " | Fluorine-containing surfactant 0.1 part | Same as in Example 10 | ○ |
| Example 13 | First ink layer & second ink layer | Fluorine-containing surfactant 0.1 part | Same as in Example 10 | ○ |

EXAMPLE 14

First, 10 parts of a terpene-phenol copolymerization resin was dissolved in 89 parts of MEK, and 1 part of an oil-soluble red dye was further dissolved to prepare a coating composition A2 for a second ink layer.

Separately, 30 parts of oxidized wax, 10 parts of low-molecular weight oxidized polyethylene and 48 parts of paraffin wax was melted under heating, and 12 parts of carbon black was further mixed. The mixture was further sand-milled for 30 minutes under heating to disperse the carbon black, whereby a coating composition B2 for a first ink layer was obtained.

The coating composition B2 was hot-melt coated on a 6 μ-PET film by means of a wire bar to form a 4 μ-thick first ink layer. Then, on the first ink layer, a colloidal silica dispersed in methanol (Methanol Silica Sol, mfd. by Nissan Kagaku Kogyo K.K.) was applied by means of an applicator and dried for 1 minute under heating at 60° C. to form a 0.3 μ-thick separation layer. Then, the coating composition A2 was applied on the separation layer by means of an application and dried for 1 minute under heating in an oven at 80° C. to form a 2 μ-thick second ink layer, whereby a heat-sensitive transfer medium was obtained.

The heat-sensitive transfer medium was cut into an 8 mm-wide tape and loaded on a heat-sensitive transfer printer for a word processor (Canoword 45S, mfd. by Canon K.K.). When the heat-sensitive transfer recording was effected at a voltage of 8.5 V on a copy paper according to the ordinary mode, clear red images were obtained. Then, a pressing member capable of pressing the transfer medium to a copy paper was disposed adjacent to the thermal head so that the transfer medium was retained in contact with the copy paper for some time after heating and then allowed to be peeled off, and the heat-sensitive transfer recording was conducted in a similar manner, whereby clear black images were obtained on a copy paper.

EXAMPLE 15

A heat-sensitive transfer medium was prepared in the same manner as in Example 14 except that a colloidal liquid of alumina hydrate (Alumina Sol-200, mfd. by Nissan Kagaku Kogyo K.K.) was used in place of the methanol silica sol used in Example 14 for the formation of a separation layer, and was evaluated in the same manner as in Example 14, whereby clear two-color images in red and black were obtained.

EXAMPLE 16

Oxidized wax in an amount of 27 parts, 9 parts of low-molecular weight oxidized polyethylene, and 49 parts of paraffin wax (m.p.=47° C.) were melted under heating, and 15 parts of Permanent Red was added thereto. The mixture was further sand-milled for 30 min. for dispersion to form an ink C2.

Separately, 30 parts of oxidized wax, and 58 parts of oxidized polyethylene was melted under heating, and 12 parts of carbon black was further mixed therewith. The mixture was sand-milled for 30 min. to disperse the carbon black, whereby an ink D2 was prepared.

Then, the coating composition D2 was applied by means of a wire bar on a 4 μ-thick PET film placed on a hot plate to form a 4 μ-thick first ink layer. After cooling the hot plate to room temperature, a colloidal silica dispersed in methanol as used in Example 16 was applied on the first ink layer by means of an applicator to form a 0.7 μ-thick separation layer.

Then, further heating the hot plate to a temperature at which the first ink layer was not melted, the ink C2 was applied on the separation layer to form a 3 μ-thick second ink layer, whereby a heat-sensitive transfer medium was prepared.

The heat-sensitive transfer medium was cut into a width of 8 mm and loaded on a heat-sensitive transfer printer for a word processor (Canoword 45S). When the heat-sensitive tarnsfer recording was effected at the minimum heat input level and at the maximum heat input level, respectively, whereby red images and black images both clear were obtained in the former and latter cases, respectively.

Comparative EXAMPLE

A heat-sensitive transfer medium was prepared in the same manner as in Example 16 except that the separation layer was not formed, and was evaluated in the same manner as in Example 16, whereby partially mixed black portions were observed in the resultant red images.

EXAMPLE 17

A terpene-phenol copolymerization resin in an amount of 10 parts was dissolved in 89.2 parts of MEK, and 0.8 part of carbon black was added to the solution. The resultant mixture was further sand-milled for 30 min. for dispersion to prepare an ink A3 for a second ink layer.

Separately, 12 parts of oxidized wax, 3 parts of ethylene-vinyl acetate copolymer and 20 parts of paraffin wax were melted under heating, and 60 parts of titanium oxide was mixed under stirring. The mixture was further subjected to dispersion under heating by means of an attritor for 2 hours to form a coating composition B3 for a first ink layer.

The coating composition B3 was hot-melt coated on a 6 μ-PET film by means of a wire bar to form a 15 μ-thick first ink layer. Then, the coating composition A3 was applied on the first ink layer and dried for 3 min. under heating in an oven 80° C. to form a 3 μ-thick second ink layer, whereby a heat-sensitive transfer medium was prepared.

The heat-sensitive transfer medium was cut into an 8 mm-wide tape and loaded on a heat-sensitive transfer printer for a word processor (Canoword 45S). When the heat-sensitive transfer recording was effected at the maximum heat input level according to the ordinary mode, a black image was obtained on a copy paper.

The black image was regarded as an error image and corrected in the following manner. Thus, the heat-sensitive transfer recording was repeated on the copy paper in a mode wherein the imprinted or heat-applied transfer medium was kept in contact with the copy paper for an extended time and then peeled off by using a pressing member disposed after the thermal head, whereby the black image was covered with and hidden by a white layer to such an extent that it was hardly recognized. Then, the pressing member was removed, and the heat-sensitive transfer recording was again conducted on the same copy paper, whereby a clear black image was imprinted on the white layer.

Thus, according to this embodiment of the present invention, the ordinary heat-sensitive transfer recording and the correction of error images can be effected without using two types of ribbons, i.e., one for ordinary imprinting and the other for correction, by using a transfer medium having a colored layer and a white layer in laminated form and by changing the timing of separation between the transfer medium and a recording medium after heating for imprinting.

What is claimed is:

1. A heat-sensitive transfer medium, comprising: a support and at least two heat-transferable ink layers including a first ink layer and a second ink layer disposed in the order named on the support;

the relative strengths between the first adhesion $F_1$ between the support and the first ink layer, and the second adhesion strength $F_2$ between the first ink layer and the second ink layer being reversed in the course of cooling of the ink layers after application of an amount of heat thereto sufficient to cause thermal transfer of the ink layers.

2. A heat transfer recording medium according to claim 1, wherein at a temperature above a given temperature, the second adhesion strength $F_2$ is less than the first adhesion strength $F_1$.

3. A heat transfer recording medium according to claim 1, wherein at a temperature above a given temperature, the second adhesion strength $F_2$ is greater than the first adhesion strength $F_1$.

4. The medium according to claim 1, wherein said first and second ink layers have different color tones.

5. The medium according to claim 4, wherein said first and second ink layers have different hues.

6. The medium according to claim 4, wherein said first and second ink layers are colored in the same hue but in different densities.

7. The medium according to claim 1, wherein said first and second ink layers have the same color tone.

8. The medium according to claim 1, wherein said first and second ink layers are heat-fusible.

9. The medium according to claim 1, which further comprises an adhesive layer between the first and second ink layers.

10. The medium according to claim 9, which further comprises an adhesive layer between the first ink layer and the support.

11. The medium according to claim 1, which further comprises an adhesive layer between the first ink layer and the support.

12. The medium according to claim 1, which further comprises a heat resistant layer between the first ink layer and the support.

13. The medium according to claim 1, which further comprises another transferable ink layer between the first ink layer and the support.

14. A heat-sensitive transfer medium, comprising:

a support;

at least two heat-fusible ink layers including a first ink layer and a second ink layer disposed in the order named on the support; and a fine powder layer which is disposed between the first and second ink layers, and which said powder layer comprises a plurality of fine particles having sizes of about 400μm or less, and which layer has a thickness of about 0.01 to 2 microns and which layer is not melted by a heat energy applied for recording.

15. The medium according to claim 14, wherein said fine powder layer comprises fine powder of at least one member selected from silicic acid anhydride, alumina and alumina hydrate having particle sizes of 400 milimicrons or smaller.

16. A heat-sensitive transfer medium, comprising: a support, and at least two heat-fusible ink layers including a first ink layer and a second ink layer, at least one heat-fusible ink layer containing a silicone oil or fluorine-containing surfactant.

17. The medium according to claim 16, wherein said at least one heat-fusible ink layer contains the silicone oil or fluorine-containing surfactant in a proportion of 50 ppm to 10% by weight.

* * * * *

UNITED STATES PATENT AND TRADEMARK OFFICE

CERTIFICATE OF CORRECTION

PATENT NO. : 5,106,676

DATED : April 21, 1992

INVENTOR(S) : Hiroshi Sato et al

It is certified that error appears in the above-indentified patent and that said Letters Patent is hereby corrected as shown below:

COLUMN 1

Line 67, "above mentioned" should read --above-mentioned--.

COLUMN 2

Line 28, "above mentioned" should read --above-mentioned--.
Line 31, "above" should read --above- --.

COLUMN 3

Line 2, "heat-senitive" should read --heat-sensitive--.
Line 6, "contact" should read --contacts--.

COLUMN 4

Line 20, "has" should read --have--.
Line 23, "above mentioned" should read --above-mentioned--.

COLUMN 5

Line 19, "consituted" should read --constituted--.
Line 57, "produce" should read --products--.
Line 58, "preferable." should read --is preferable.--.
Line 62, "thich" should read --thick--.

UNITED STATES PATENT AND TRADEMARK OFFICE

CERTIFICATE OF CORRECTION

PATENT NO. : 5,106,676

DATED : April 21, 1992

INVENTOR(S) : Hiroshi Sato et al

It is certified that error appears in the above-indentified patent and that said Letters Patent is hereby corrected as shown below:

COLUMN 6

Line 43, "plasticizers" should read --plasticizer--.
Line 63, "above men-" should read --above-men- --.
Line 65, "ooils" should read --oils--.

COLUMN 7

Line 15, "above mentioned" should read --above-mentioned--.
Line 47, "obtain" should read --to obtain--.
Line 54, "type writer" should read --typewriter--.

COLUMN 8

Line 16, "length 1" should read --length ℓ--.
Line 52, "head 7." should read --head 6.--.

COLUMN 9

Line 14, "fluorine containing" should read --fluorine-containing--.
Line 41, "being" should read --is--.
Line 62, "layer 4" should read --layer 4 and--.

COLUMN 11

Line 43, "ant, e.g., by" should read --ant formed by, e.g.,--.

UNITED STATES PATENT AND TRADEMARK OFFICE

CERTIFICATE OF CORRECTION

PATENT NO. : 5,106,676

DATED : April 21, 1992

INVENTOR(S) : HIROSHI Sato et al

It is certified that error appears in the above-indentified patent and that said Letters Patent is hereby corrected as shown below:

COLUMN 12

Line 66, "tranferability" should read --transferability--.

COLUMN 13

Line 15, "one" should read --one or--.
Line 24, "farry" should read --fatty--.
Line 25, "acid" (fourth occurrence) should read --acid;--.

COLUMN 14

Line 18, "above mentioned" should read --above-mentioned--.
Line 20, "above mentioned" should read --above-mentioned--.
Line 36, "above mentioned" should read --above-mentioned--.
Line 38, "A" should begin a new paragraph.

COLUMN 15

Line 4, "senitive" should read --sensitive--.

COLUMN 16

Line 26, "slided" should read --slid--.
Line 40, "paper 27" should read --paper 22--.

UNITED STATES PATENT AND TRADEMARK OFFICE

CERTIFICATE OF CORRECTION

PATENT NO. : 5,106,676

DATED : April 21, 1992

INVENTOR(S) : Hiroshi Sato et al

It is certified that error appears in the above-indentified patent and that said Letters Patent is hereby corrected as shown below:

COLUMN 17

Line 3, "motor 39" should read --motor 33--.
Line 7, "ink," should read --ink--.

COLUMN 18

Line 1, "and" should read --or--.
Line 42, "hot-molt-coated" should read --hot-melt-coated--.

COLUMN 19

Line 44, "µm-" should read --2 µm- --.

COLUMN 20

Line 67, "1.5 µ7-thick" should read --1.5 µm-thick--.

COLUMN 21

Line 18, "Fig. 9." should read --Fig. 9 was formed.--.
Line 57, "PET" should read --PET film--.

COLUMN 22

Line 18, "λm-thick PET back coated" should read --µm-thick PET film back-coated--.
Line 20, "ink" should read --second ink-- and "wehreby" should read --whereby--.

UNITED STATES PATENT AND TRADEMARK OFFICE

CERTIFICATE OF CORRECTION

PATENT NO. : 5,106,676

DATED : April 21, 1992

INVENTOR(S) : Hiroshi Sato et al

It is certified that error appears in the above-indentified patent and that said Letters Patent is hereby corrected as shown below:

COLUMN 23

Line 40, "use" should read --the--.

COLUMN 24

Table, "promotor" (both occurrences) should read --promoter--.
Line 28, "was" should read --were--.

COLUMN 25

Line 10, "was" should read --were--.
Line 28, "When" should read --Then--.
Line 29, "tarnsfer" should read --transfer--.
Line 35, "Comparative" should read --COMPARATIVE--.
Line 62, "oven" should read --oven at--.

UNITED STATES PATENT AND TRADEMARK OFFICE

CERTIFICATE OF CORRECTION

PATENT NO. : 5,106,676

DATED : April 21, 1992

INVENTOR(S) : Hiroshi Sato et al

It is certified that error appears in the above-indentified patent and that said Letters Patent is hereby corrected as shown below:

COLUMN 26

Line 30, "$F_1$" should read --strength $F_1$--.

COLUMN 28

Line 4, "400 milimi-" should read --400 millimi- --.

Signed and Sealed this

Fourteenth Day of September, 1993

Bruce Lehman

*Attest:*

BRUCE LEHMAN

*Attesting Officer*

*Commissioner of Patents and Trademarks*